US010048610B2

(12) United States Patent
Kanno et al.

(10) Patent No.: US 10,048,610 B2
(45) Date of Patent: Aug. 14, 2018

(54) TONER AND METHOD FOR MANUFACTURING TONER

(71) Applicant: CANON KABUSHIKI KAISHA, Tokyo (JP)

(72) Inventors: Ichiro Kanno, Kashiwa (JP); Takeshi Hashimoto, Moriya (JP); Masayuki Hama, Toride (JP); Hitoshi Sano, Tokyo (JP); Nozomu Komatsu, Toride (JP); Tsubasa Fujisaki, Toride (JP); Takakuni Kobori, Toride (JP); Hiroyuki Fujikawa, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/384,807

(22) Filed: Dec. 20, 2016

(65) Prior Publication Data

US 2017/0176880 A1 Jun. 22, 2017

(30) Foreign Application Priority Data

Dec. 21, 2015 (JP) ..... 2015-248312

(51) Int. Cl.
*G03G 9/097* (2006.01)
*G03G 9/087* (2006.01)
*G03G 9/08* (2006.01)

(52) U.S. Cl.
CPC ..... *G03G 9/09725* (2013.01); *G03G 9/0827* (2013.01); *G03G 9/08755* (2013.01)

(58) Field of Classification Search
CPC ..... G03G 9/09725
See application file for complete search history.

(56) References Cited

U.S. PATENT DOCUMENTS 5,397,667 A * 3/1995 Law ..... G03G 9/09725 430/108.6
2003/0152506 A1* 8/2003 Shibasaki ..... C01B 33/183 423/335
2008/0124636 A1* 5/2008 Yamaguchi ..... G03G 9/09725 430/110.3
2009/0253851 A1* 10/2009 Ohara ..... C01B 33/181 524/493
2015/0037720 A1* 2/2015 Tsuda ..... G03G 9/09725 430/108.3

FOREIGN PATENT DOCUMENTS

JP 2001022118 A * 1/2001
JP 2002114510 A * 4/2002 ..... C03B 19/106
JP 2012-163623 A 8/2012
JP 2013-190646 A 9/2013
JP 2014-77930 A 5/2014

OTHER PUBLICATIONS

English language machine translation of JP 2002-114510 (Apr. 2002).*
Duke, C.B.; Noolandi, J.; Thieret, T. "The surface science of xerography" Surface Science 500 (2002) 1005-1023.*
English language machine translation of JP 2001-022118 (Jan. 2001).*

* cited by examiner

*Primary Examiner* — Christopher D Rodee
(74) *Attorney, Agent, or Firm* — Canon U.S.A., Inc. IP Division

(57) ABSTRACT

A toner containing a toner particle containing a binding resin and a colorant and an inorganic fine particle, in which the inorganic fine particle is a silica particle containing aluminum and the content of the aluminum in the silica particle is 0.2 ppm or more and 200 ppm or less.

6 Claims, 1 Drawing Sheet

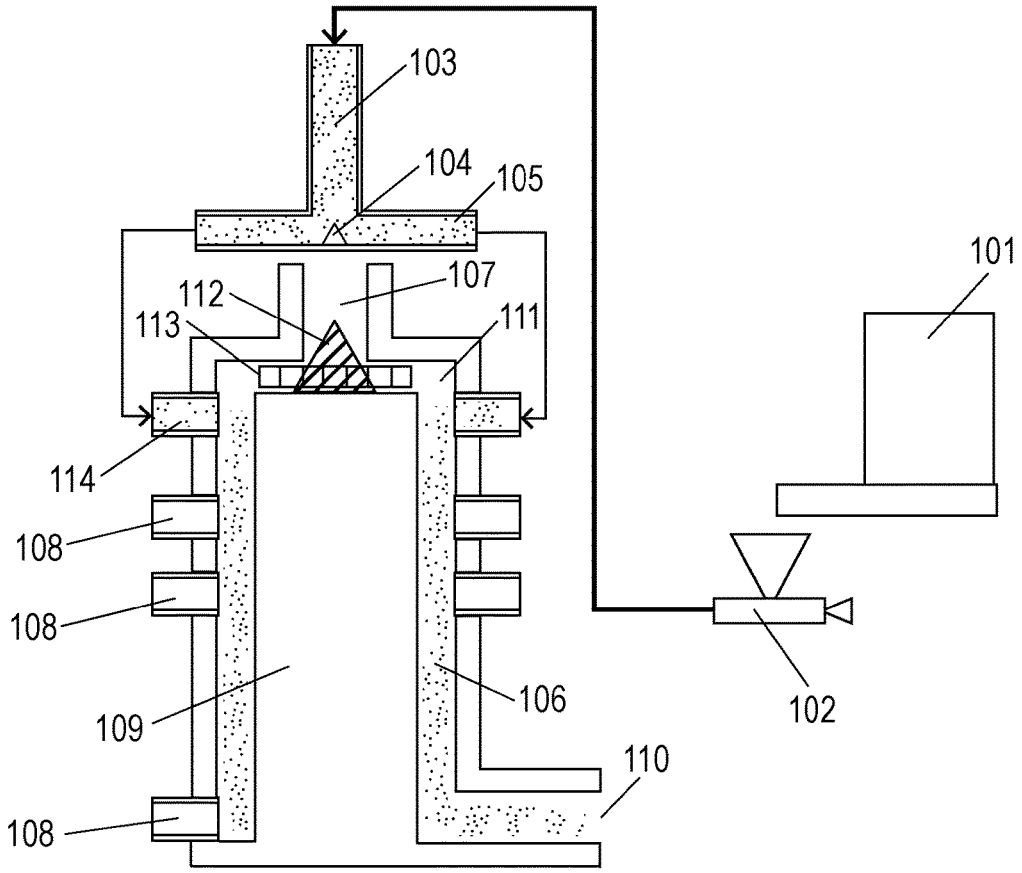
103
104
105
101
107
112
113
111
114
108
108
109
106
102
110
108

TONER AND METHOD FOR MANUFACTURING TONER

BACKGROUND OF THE INVENTION

Field of the Invention

The present disclosure relates to a toner for use in an electrophotographic system, an electrostatic recording system, and an electrostatic printing system, a two-component developer, and a method for manufacturing a toner.

Description of the Related Art

In recent years, with a rapid spread of an electrophotographic full color image forming apparatus, the uses thereof also has variously spread and a demand for image quality has also more increased more than before.

Nowadays, advances in the printing field of the electrophotographic full color image forming apparatus have been significant. Images output by the electrophotographic system have also been required to have image quality (high brilliance, high definition, granularity, and the like) equal to or higher than the image quality of images output by former printing methods.

Furthermore, there is a need for an improvement of image output speed, a reduction in running cost, stability of image quality irrespective of environments, and the like. There is a need for a toner satisfying these various needs.

The image output speed of an image forming apparatus is directly linked to productivity in the commercial printing use and relates to the operation efficiency in the use in offices. Therefore, a need for an image forming apparatus with a high image output speed (high-speed machine) has increased.

In the high-speed machine, a two-component developer containing a toner and a magnetic carrier in combination is suitably used due to high toner supply ability to a photoconductive drum. In the case of the two-component developer, strong stress is applied to a toner from the magnetic carrier as compared with a one-component developer. Therefore, there is a need for a toner having high resistance to stress.

Moreover, there is a need for a toner to have durability with which high quality images can be stably obtained even when images are continuously output for a long time period and environmental stability with which stable images can be obtained also under various temperature and humidity environments.

Heretofore, in an electrophotographic toner, an inorganic fine particle and the like has been generally externally-added to the surface of a toner particle for the purpose of adjusting the fluidity, the adhesion, the chargeability, and the like of the toner to obtain good developability, transferability, and cleaning performance.

However, when stress is applied to the toner, the inorganic fine particle is sometimes separated from the surface of the toner particle. Then, when the separated inorganic fine particle contaminates a roller-shaped charging member (hereinafter also referred to as a "charging roller"), uneven resistance arises in the charging roller to cause image defects of uneven image density in some cases.

Moreover, the fluidity of the toner decreases under the influence of the separation of the inorganic fine particle from the toner particle, and thus the charge amount distribution of the toner spreads, so that the developability of the toner is impaired, which causes the adhesion of the toner to a non-image portion, i.e., so-called fogging, in some cases.

In the case of the two-component developer, stress is applied to the toner from the magnetic carrier due to stirring in a development device. Therefore, there is a tendency that the inorganic fine particle is likely to be separated from the surface of the toner particle. In particular, when images are continuously output with a high-speed machine for a long time period, image defects caused by contaminating a charge imparting member are likely to be obvious.

Then, in recent years, an examination of externally adding various silica particles to the surface of the toner particle has been performed as one of the techniques of increasing the charge stability and the anticontamination of the charge imparting member.

Japanese Patent Laid-Open No. 2012-163623 discloses a technique of preventing the fogging to a non-image portion by adding silica particle having a specific surface area of 10.0 $m^2/g$ or more and 50.0 $m^2/g$ or less to toner particle, and then subjecting the toner particle to surface treatment by heat.

Moreover, Japanese Patent Laid-Open Nos. 2013-190646 and 2014-77930 disclose techniques of adding non-spherical silica particle to toner particle to increase the transferability and prevent image defects.

However, in the case where images are output at a high speed or in the case where images are output over a long time period, strong stress is applied to a toner from a magnetic carrier due to stirring in a development device. Therefore, there has been room for improvement to the problem of the reduction in charge stability of the toner due to the influence of humidity, the contamination of a charge imparting member, and the like.

SUMMARY OF THE INVENTION

The present disclosure provides a toner capable of outputting images in which fogging and uneven density are improved even when images are output at a high speed or even when images are output over a long time period in a high temperature and high humidity environment or in a normal temperature and normal humidity environment. Moreover, the present disclosure provides a two-component developer containing the toner and a method for manufacturing the toner.

The present disclosure relates to a toner containing a toner particle containing a binding resin and a colorant and an inorganic fine particle, in which the inorganic fine particle is a silica particle containing aluminum and the content of the aluminum in the silica particle is 0.2 ppm or more and 200 ppm or less.

The present disclosure also relates to a two-component developer containing a toner and a magnetic carrier, in which the toner is a toner containing a toner particle containing a binding resin and a colorant and an inorganic fine particle, the inorganic fine particle is a silica particle containing aluminum, and the content of the aluminum in the silica particle is 0.2 ppm or more and 200 ppm or less.

The present disclosure also relates to a method for manufacturing a toner containing a toner particle containing a binding resin and a colorant and an inorganic fine particle, in which the inorganic fine particle is a silica particle containing aluminum, and the content of the aluminum in the silica particle is 0.2 ppm or more and 200 ppm or less, and the manufacturing method includes a process of manufacturing the silica particle through a process of adding at least one kind of aluminum salt selected from the group consisting of polyaluminum hydroxide, polyaluminum chloride, aluminum chloride, and aluminum sulfate, and/or a polymer thereof to colloidal silica.

Further features of the present disclosure will become apparent from the following description of exemplary embodiments with reference to the attached drawing.

BRIEF DESCRIPTION OF THE DRAWINGS

FIGURE is a view illustrating an example of a surface treatment apparatus which surface-treats a toner by heat.

DESCRIPTION OF THE EMBODIMENTS

The present disclosure relates to a toner containing a toner particle containing a binding resin and a colorant and an inorganic fine particle, in which the inorganic fine particle is a silica particle containing aluminum and the content of the aluminum in the silica particle is 0.2 ppm or more and 200 ppm or less.

The present inventors have found that a toner excellent in charge stability is obtained under the following conditions: at least one kind of the inorganic fine particle contained in the toner is silica particle containing aluminum; and the content of the aluminum in the silica particle is in a specific range.

This is considered to be because the aluminum present in the silica particle is positively charged. Therefore, due to the fact that the silica particle contacts the surface of the toner particle which is negatively charged, the silica particle serves as a dielectric to cause polarization of the charges, so that the chargeability of the toner is improved. Furthermore, it is presumed that the aluminum can be stably present in the silica particle, and therefore the chargeability of the toner can be maintained at a high level.

The silica particle for use in the toner contains aluminum and the content thereof is required to be 0.2 ppm or more and 200 ppm or less and is suitably 0.5 ppm or more and 100 ppm or less. Due to the fact that the content of the aluminum is in the ranges mentioned above, the charge stability of the toner can be increased.

When the content of the aluminum in the silica particle is less than 0.2 ppm, the electric neutralization in the silica particle is in an imperfect state, and therefore the effects expected are difficult to be exhibited.

When the content of the aluminum in the silica particle exceeds 200 ppm, the positive charges in the silica particle are excessively present, and therefore the charge balance in the silica particle is lost, which causes fogging and a reduction in the degree of scattering in some cases.

The silica particle for use in the toner is suitably secondary aggregated silica particle manufactured by a sol-gel method using the aluminum as a flocculating agent for silica. By the use of such a silica particle, external stress to be applied to the toner can be reduced. Thus, the embedding of the silica particle in the surface of the toner particle when image formation is performed over a long time period can be prevented and the charge stability of the toner can be increased.

The silica particle is suitably silica particle produced through a process of adding at least one kind of aluminum salt selected from the group consisting of polyaluminum hydroxide, polyaluminum chloride, aluminum chloride, and aluminum sulfate, and/or a polymer thereof to colloidal silica. Among the above, the silica particle is suitably silica particle produced through a process of adding polyaluminum chloride and/or a polymer thereof to colloidal silica. This is because the aggregation effect of the polyaluminum chloride is high and the charge stability of the toner can be further increased.

The shape factor SF-1 of the silica particle for use in the toner is suitably 135 or more and less than 180 and more suitably 150 or more and less than 165.

When the shape factor SF-1 is 135 or more, stress due to contact with a carrier or other charge imparting members is not excessively large, the stable chargeability can be maintained, and fogging and image density changes hardly occur.

On the other hand, when the shape factor SF-1 is less than 180, the contact surface of the silica particle with the surface of the toner particle is sufficient, the chargeability easily improves, and image density changes are hard to occur.

The shape factor SF-1 of the silica particle can be adjusted by the type and the addition amount of aluminum to be used as a flocculating agent.

The specific surface area of the silica particle to be used for the toner is suitably 5 $m^2/g$ or more and 50 $m^2/g$ or less and more suitably 15 $m^2/g$ or more and 35 $m^2/g$ or less.

When the specific surface area is 5 $m^2/g$ or more, the sticking strength between the surface of the toner particle and the silica particle is sufficient. Therefore, when used as a two-component developer, the separation of the silica particle can be prevented and the occurrence of image defects due to a reduction in the charge-imparting performance resulting from the contamination of a charging roller can be prevented.

On the other hand, when the specific surface area is 50 $m^2/g$ or less, the specific surface area of the silica particle is not excessively large and the silica particle are not excessively embedded in the surface of the toner particle, and therefore stress due to the contact with a carrier or other charge imparting members is not excessively large. Therefore, stable chargeability can be maintained and fogging and image density changes are hard to occur.

The specific surface area of the silica particle can be adjusted by the type and the addition amount of aluminum to be used as a flocculating agent and the type and the addition amount of treatment agents when the silica particle is produced by a wet production method. When the silica particle is produced by a dry production method, the specific surface area of the silica particle can be adjusted by controlling the amount and the flow rate of inflammable gas and oxygen.

In the toner, the coverage with the silica particle of the surface of the toner particle is suitably 30% or more and 90% or less and more suitably 50% or more and 80% or less.

When the coverage is 30% or more, the number of the silica particles present on the surface of the toner particle is sufficient. Therefore, the toner is hardly affected by humidity, the stable chargeability can be maintained, and fogging and image density changes hardly occur.

On the other hand, when the coverage is 90% or less, the number of the silica particles present on the surface of the toner particle is not excessively large. Therefore, the frictional force acting between the toner and the carrier is hard to be excessively small. Therefore, the improvement effect of the chargeability is likely to be demonstrated.

The coverage can be adjusted by controlling the addition amount of the silica particle and the mixing time of the toner particle and the silica particle.

In the toner, the sticking ratio to the surface of the toner particle of the silica particle is suitably 50% by mass or more and 100% by mass or less and more suitably 70% by mass or more and 100% by mass or less.

When the sticking ratio is 50% by mass or more, the silica particle is difficult to be separated from the surface of the toner particle, so that the charging roller is hard to be contaminated. Therefore, image defects resulting from a reduction in charge-imparting performance is hard to occur. The sticking ratio can be adjusted by controlling the mixing conditions of the toner particle and the silica particle and the surface treatment temperature.

The average circularity of the toner is suitably less than 0.970 and more suitably less than 0.967.

When the average circularity of the toner is less than 0.970, the space between the surface of the toner particle and the surface of carrier particle is sufficient, the toner and the carrier are easily mixed with each other during toner supply, and the rise of the chargeability is sufficient. Therefore, the image density changes are difficult to occur. The average circularity of the toner can be adjusted by controlling the surface treatment temperature.

EXAMPLES

Hereinafter, the present disclosure is specifically described with reference to Examples. However, the present invention is not limited thereto.

Binding Resin

A binding resin for use in the toner is not particularly limited and the following polymers or resin can be used.

For example, usable are homopolymers of styrene and substituents thereof, such as polystyrene, poly-p-chlorostyrene, and polyvinyl toluene;

styrene-based copolymers, such as a styrene-p-chlorostyrene copolymer, a styrene-vinyltoluene copolymer, a styrene-vinyl naphthalene copolymer, a styrene-acrylate copolymer, a styrene-methacrylate copolymer, a styrene-α-chloromethyl methacrylate copolymer, a styrene-acrylonitrile copolymer, a styrene-vinyl methyl ether copolymer, a styrene-vinyl ethyl ether copolymer, a styrene-vinyl methyl ketone copolymer, and a styrene-acrylonitrile-indene copolymer;

polyvinyl chloride;

phenol resin;

natural modified phenol resin;

natural resin modified maleic acid resin;

acrylic resin and methacrylic resin;

polyvinyl acetate;

silicone resin;

polyester;

polyurethane;

polyamide;

furan resin;

epoxy resin;

xylene resin;

polyvinyl butyral;

terpene resin;

coumarone-indene resin;

petroleum-based resin, and the like.

Among the above, polyester is suitable from the viewpoint of low-temperature fixability and chargeability controllability.

Polyester suitably used is a resin having a "polyester unit" in the resin chain. Examples of components forming the polyester unit include divalent or more alcohol monomer components and acid monomer components, such as divalent or more carboxylic acids, divalent or more carboxylic acid anhydrides, and divalent or more carboxylic acid esters, for example.

Examples of the divalent or more alcohol monomer components, the following substances are mentioned, for example.

Mentioned are alkylene oxide adducts of bisphenol A, such as polyoxypropylene(2.2)-2,2-bis(4-hydroxyphenyl) propane, polyoxypropylene(3.3)-2,2-bis(4-hydroxyphenyl) propane, polyoxyethylene(2.0)-2,2-bis(4-hydroxyphenyl) propane, polyoxypropylene(2.0)-polyoxyethylene(2.0)-2,2-bis(4-hydroxyphenyl)propane, and polyoxypropylene(6)-2,2-bis(4-hydroxyphenyl)propane, ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Among the above, aromatic diols are suitable as the alcohol monomer components. In units derived from the alcohol monomer components contained in polyester, a unit derived from the aromatic diols is suitably 80% by mol or more.

As the acid monomer components, such as the divalent or more carboxylic acids, the divalent or more carboxylic acid anhydrides, and the divalent or more carboxylic acid esters, the following substances are mentioned, for example.

Mentioned are aromatic dicarboxylic acids, such as phthalic acid, isophthalic acid, and terephthalic acid, or anhydrides thereof;

alkyl dicarboxylic acids, such as succinic acid, adipic acid, sebacic acid, and azelaic acid, or anhydrides thereof; succinic acids substituted by alkyl groups or alkenyl groups having 6 to 18 carbon atoms or anhydrides thereof; and unsaturated dicarboxylic acids, such as fumaric acid, maleic acid, and citraconic acid, or anhydrides thereof.

Among the above, the acid monomer components are suitably polycarboxylic acids, such as terephthalic acid, succinic acid, adipic acid, fumaric acid, trimellitic acid, pyromellitic acid, benzophenone tetracarboxylic acid, and anhydrides thereof.

The acid value of the polyester is suitably 20 mgKOH/g or less from the viewpoint of the dispersibility of pigments and the stability of the triboelectric charging amount.

The acid value can be set in the range mentioned above by adjusting the type and the compounding amount of monomers to be used for manufacturing polyester. For example, the acid value can be controlled by adjusting Alcohol monomer component ratio/Acid monomer component ratio and the molecular weight during the production of polyester. Alternatively, the acid value can be controlled by causing terminal alcohols to react with polyvalent acid monomers (for example, trimellitic acid) after condensation polymerization of esters.

Wax

In the toner particle of the toner, wax can be compounded as necessary. As the wax, the following substances are mentioned, for example.

Mentioned are hydrocarbon waxes, such as low molecular weight polyethylene, low molecular weight polypropylene, an alkylene copolymer, microcrystalline wax, paraffin wax, and Fischer-Tropsch wax;

oxides of hydrocarbon waxes, such as oxidized polyethylene wax, or block copolymers thereof;

waxes containing fatty acid esters, such as carnauba wax, as the main component;

substances obtained by deacidifying partially or entirely fatty acid esters, such as deacidified carnauba wax;

saturated straight chain fatty acids, such as pulmitic acid, stearic acid, and montanic acid;

unsaturated fatty acids, such as brassidic acid, eleostearic acid, and parinaric acid;

saturated alcohols, such as stearyl alcohol, aralkyl alcohol, behenyl alcohol, carnaubyl alcohol, ceryl alcohol, and melissyl alcohol;

polyhydric alcohols such as sorbitol;

esters of fatty acids, such as pulmitic acid, stearic acid, behenic acid, and montanic acid, and alcohols, such as stearyl alcohol, aralkyl alcohol, behenyl alcohol, carnaubyl alcohol, ceryl alcohol, and melissyl alcohol;

fatty acid amides, such as linoleic acid amide, oleic acid amide and lauric acid amide;

saturated fatty acid bisamides, such as methylenebisstearic acid amide, ethylenebiscapric acid amide, ethylenebislauric acid amide, and hexamethylenebisstearic acid amide;

unsaturated fatty acid amides, such as ethylenebisoleic acid amide, hexamethylenebisoleic acid amide, N,N'-dioleyladipic acid amide, and N,N'-dioleylsebacic acid amide;

aromatic bisamides, such as m-xylenebisstearic acid amide and N,N'-distearylisophthalic acid amide;

fatty acid metal salts (commonly referred to as metal soaps), such as calcium stearate, calcium laurate, zinc stearate, and magnesium stearate;

waxes obtained by grafting vinyl monomers, such as styrene and acrylic acid, to aliphatic hydrocarbon waxes;

partially esterified compounds of fatty acids and polyhydric alcohols, such as behenic acid monoglyceride, and methyl ester compounds having a hydroxyl group obtained by hydrogenating vegetable oils.

Among such waxes, the hydrocarbon waxes, such as paraffin wax and Fischer-Tropsch wax, are suitable from the viewpoint of low-temperature fixability and fixing and wrapping resistance.

The content of the wax in the toner particle is suitably 0.5 part by mass or more and 20 parts by mass based on 100 parts by mass of the binding resin in the toner particle.

The peak temperature of the maximum endothermic peak in a temperature range of 30° C. or more and 200° C. or less in the endothermic curve during the temperature rise measured with a differential scanning calorimeter (DSC) is suitably 50° C. or more and 110° C. or less from the viewpoint of achieving both the storageability and hot offset resistance of the toner.

Colorant

In the toner particle of the toner, a colorant can be compounded.

Examples of black colorants include, for example, carbon black; and colorants whose color is adjusted to black using a yellow colorant, a magenta colorant, and a cyan colorant.

For the colorant, pigments may be used alone. However, it is more suitable to use a dye and a pigment in combination to increase the definition from the viewpoint of the image quality of full color images.

Among magenta colorants, the following substances are mentioned as pigments, for example.

Mentioned are C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, 269, and 282;

C.I. Pigment Violet 19; and

C.I. Vat Red 1, 2, 10, 13, 15, 23, 29, and 35.

Among magenta colorants, the following substances are mentioned as dyes, for example.

Mentioned are oil soluble dyes, such as C.I. Solvent Red 1, 3, 8, 23, 24, 25, 27, 30, 49, 81, 82, 83, 84, 100, 109, and 121;

C.I. Disperse Red 9;

C.I. Solvent Violet 8, 13, 14, 21, and 27; and

C.I. Disperse Violet 1, and basic dyes, such as C.I. Basic Red 1, 2, 9, 12, 13, 14, 15, 17, 18, 22, 23, 24, 27, 29, 32, 34, 35, 36, 37, 38, 39, and 40; and C.I. Basic Violet 1, 3, 7, 10, 14, 15, 21, 25, 26, 27, and 28.

Among cyan colorants, the following substances are mentioned as pigments, for example.

Mentioned are C.I. Pigment Blue 2, 3, 15:2, 15:3, 15:4, 16, and 17;

C.I. Vat Blue 6;

C.I. Acid Blue 45; and copper phthalocyanine pigments obtained by substituting 1 to 5 phthalimidomethyl groups on a phthalocyanine skeleton.

Among cyan colorants, C.I. Solvent Blue 70 is mentioned as a dye, for example.

Among yellow colorants, the following substances are mentioned as pigments, for example.

Mentioned are C.I. Pigment Yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181, and 185; and C.I. Vat Yellow 1, 3, and 20.

Among yellow colorants, C.I. Solvent Yellow 162 is mentioned as a dye, for example.

The content of the colorants in the toner particle is suitably 0.1 part by mass or more and 30 parts by mass or less based on 100 parts by mass of the binding resin.

Charge Control Agent

In the toner particle of the toner of the present disclosure, a charge control agent can be compounded as necessary.

Various substances can be used as the charge control agent. In particular, metal compounds of aromatic carboxylic acids which are colorless, have high toner charging speed, and can stably maintain a constant charge amount are suitable.

As negative charge control agents, the following substances are mentioned, for example.

Mentioned are salicylic acid metal compounds, naphthoic acid metal compounds, dicarboxylic acid metal compounds, polymer compounds having sulfonic acids or carboxylic acids in a side chain, polymer compounds having sulfonic acid salts or sulfonic acid esterified substances in a side chain, polymer compounds having carboxylic acid salts or carboxylic acid esterified substances in a side chain, boron compounds, urea compounds, silicon compounds, calixarene.

The charge control agent may be internally or externally added to the toner particle. The content of the charge control agent is suitably 0.2 part by mass or more and 10 parts by mass or less based on 100 parts by mass of the binding resin.

Silica Particle

The silica particle for use in the toner is obtained by, for example, adding an inorganic flocculating agent to monodisperse colloidal silica to form secondary aggregated particles, and then adding active silica to unify the aggregated silica particles. The surfaces of silica fine particle present as a suspensoid in water are negatively charged and repel each other, and therefore the stable state is maintained. When aluminum salt or a polymer thereof is added thereto, the silica particle reacts with an alkaline component in water to generate positively-charged aluminum hydroxide. Then, the negative charges of the surface of the silica particle in the suspensoid are neutralized with the positive charges, whereby aggregation takes place, so that a floc (cohesion cluster) is formed.

As the flocculating agent, aluminum salt selected from the group consisting of polyaluminum hydroxide, polyaluminum chloride, aluminum chloride, and aluminum sulfate or a polymer thereof is suitable. The reason why such a flocculating agent is suitable is as follows: such a flocculating agent is easily mixed with the silica particle present as a suspensoid in water, allows uniform supply of positive charges, and can increase the charge stability of the toner. The addition amount thereof is suitably set to 0.2 ppm or more and 200 ppm or less.

The surface of the silica particle is suitably hydrophobized by surface treatment. Due to the fact that the surface is hydrophobized, moisture absorption of the silica particle in a high temperature and high humidity environment is prevented and the chargeability of the toner increases.

As the surface treatment, surface treatment including silane coupling treatment, oil treatment, and fluorine treatment and the like can be mentioned, for example. Two or more kinds of surface treatment can be employed and the order of the two or more kinds of surface treatment is determined as desired.

As a silane coupling agent for use in the silane coupling treatment, the following substances are mentioned, for example.

Mentioned are hexamethyldisilazane, trimethylsilane, trimethylchlorosilane, trimethylethoxysilane, dimethyldichlorosilane, methyltrichlorosilane, allyldimethychlorosilane, allylphenyldichlorosilane, benzyldimethychlorosilane, bromomethyldimethylchlorosilane, α-chloroethyltrichlorosilane, β-chloroethyltrichlorosilane, chloromethyldimethylchlorosilane, triorganosilylacrylate, vinyldimethylacetoxysilane, dimethylethoxysilane, dimethyldimethoxysilane, diphenyldiethoxysilane, hexamethyldisiloxane, 1,3-divinyltetramethyldisiloxane, and 1,3-diphenyltetramethyldisiloxane.

As a silane coupling agent treatment method, a dry method including causing an evaporated silane coupling agent to react with fine particles formed into a cloud shape by stirring is mentioned, for example. Moreover, a wet method including dispersing fine particles in a solvent, and then causing a silane coupling agent to react in dropping therewith is also mentioned.

Examples of the oil treatment include treatment using silicone oil, fluorine oil, and various kinds of modified oil, for example. As oil, the following substances are mentioned, for example.

Mentioned are dimethyl silicone oil, alkyl-modified silicone oil, α-methylstyrene-modified silicone oil, chlorophenyl silicone oil, and fluorine-modified silicone oil.

As the silicone oil, one having a viscosity at a temperature of 25° C. of 50 to 100 $mm^2$/second is suitable. The oil processing amount is suitably in the range of 3 to 35 parts by mass of the oil based on 100 parts by mass of a bulk of the silica particle.

Silica particle produced by methods, such as dry methods and wet methods, other than the silica particle described above can also be used in combination for the toner particle.

Examples of the dry methods include a fumed method including burning silicon tetrachloride with mixed gas of oxygen gas, hydrogen gas, and diluent gas (for example, gas, such as nitrogen, argon, and carbon dioxide) at a high temperature to produce a silica particle, for example.

Examples of the wet methods include a sol-gel method including subjecting alkoxysilane to hydrolysis and condensation reaction with a catalyst in an organic solvent in which water is present, removing the solvent from the obtained silica sol suspension, and then drying the resultant substance.

The toner may also contain other fine particles for imparting (assisting) fluidity and the like other than the silica particle containing aluminum and the other silica particle.

For example, examples of fluidity imparting agents include fine particles of metal oxides (alumina, titanium oxide, carbon black, and the like) and those subjected to hydrophobic treatment are suitable. The crystal form of titanium oxide may be an anatase type or a rutile type.

The silica particle containing aluminum according to the present disclosure is suitably contained in the toner in a proportion of 0.1 part by mass or more and 10.0 parts by mass or less based on 100 parts by mass of the toner particle.

For the mixing of the toner particle with the silica particle, mixers, such as a Henschel mixer, can be used, for example.

The toner is suitably mixed with a magnetic carrier to be used as a two-component developer from the viewpoint of obtaining images stable over a long time period.

As magnetic carrier particle of the magnetic carrier, the following substances are mentioned, for example.

Mentioned are iron particle having an oxidized surface and iron particle having an unoxidized surface, metal particles of iron, lithium, calcium, magnesium, nickel, copper, zinc, cobalt, manganese, rare earth, and the like, alloy particles thereof, magnetic substances, such as oxide particles and ferrite, and a magnetic substance dispersion resin carrier particle containing magnetic substances and a binding resin holding the magnetic substances in a dispersed state (so-called resin carrier particle).

Method for Manufacturing Toner

Examples of a method for manufacturing a toner include manufacturing methods, such as a pulverization method, a suspension polymerization method, and an emulsion polymerization method, for example.

Hereinafter, a description is given taking a method for manufacturing a toner using a pulverization method as an example.

A raw material mixing process includes weighing predetermined amounts of a binding resin and wax and, as necessary, other components, such as a colorant and a charge control agent, for example, as materials forming a toner particle, and then mixing the materials. Examples of mixing devices include a double cone mixer, a V-shaped mixer, a drum-shaped mixer, a super mixer, a Henschel mixer, a Nauta mixer, a MECHANO HYBRID (manufactured by NIPPON COKE &. ENGINEERING CO., LTD.), and the like, for example.

Next, the mixed material is melted and kneaded to disperse the wax and the like in the binding resin. In the melting and kneading process, a batch type kneader, such as a pressure kneader or a Banbury mixer, a continuous-type kneader, or the like can be used. Among the above, single- or twin-screw extruders are suitable from the viewpoint of continuous production. Examples of extruders include a KTK-type twin-screw extruder (manufactured by Kobe Steel, Ltd.), a TEM-type twin-screw extruder (manufactured by Toshiba Machine Co., Ltd.), a PCM mixer (manufactured by Ikegai Iron Works Co), a twin-screw extruder (manufactured by KCK Co.), a Ko-kneader (manufactured by Buss AG), and a Kneadex (manufactured by Nippon Coke & Engineering Co., Ltd.), for example.

A resin composition obtained by melting and kneading may be rolled using twin rolls or the like, and may be cooled with water or the like in a cooling process.

The cooled substance of the resin composition is pulverized into a desired particle diameter in a pulverization process.

In the pulverization process, the cooled substance of the resin composition is coarsely pulverized using a pulverization device, such as a crusher, a hammer mill, a feather mill, or the like, and further finely pulverized using a fine pulverizer. Examples of the fine pulverization device include a Kryptron System (manufactured by Kawasaki Heavy Industries Ltd.), a Super Rotor (manufactured by Nisshin Engineering Inc.), a Turbo Mill (manufactured by FREUND TURBO), an air-jet fine pulverizer, and the like.

Thereafter, the pulverized substance is classified using a classifier or a sieving device, such as an Elbow-Jet (manufactured by Nittetsu Mining Co., Ltd.) employing an inertial classification system, a Turboplex (manufactured by Hosokawa Micron Group) employing a centrifugal classification system, a TSP separator (manufactured by Hosokawa Micron Group), and a Faculty (manufactured by Hosokawa Micron Group), to obtain a toner particle.

The toner particle obtained by the manufacturing method described above is suitably heat-treated for spheronization treatment. By performing the heat treatment for spheronization, the spheronization can be more efficiently performed, and further the silica particle can be caused to strongly adhere to the surface of the toner particle. Examples of a heat treatment process include a process of performing surface treatment by heat using a surface treatment apparatus illustrated in FIGURE, for example.

In FIGURE, a mixture supplied in a fixed amount by a fixed-amount raw material supply means 101 is guided to an introduction tube 103 disposed on the vertical line of the raw material supply means by compressed gas adjusted by a compressed gas adjustment means 102. The mixture passing through the introduction tube is uniformly dispersed by a conical-shaped protrusion member 104 provided in a central portion of the raw material supply means, guided to a supply tube 105 in eight directions which radially spread, and then guided to a treatment chamber 106 where heat treatment is performed.

In this process, the flow of the mixture supplied to the treatment chamber 106 is regulated by a regulation means 109 for regulating the flow of the mixture provided in the treatment chamber. Therefore, the mixture supplied to the treatment chamber is heat-treated while rotating in the treatment chamber, and then cooled.

The heat for heat-treating the supplied mixture is supplied from a hot air supply means 107, and then distributed by a distribution member 112. Then, hot air is introduced into the treatment chamber by being spirally rotated by a rotation member 113 for rotating hot air. As the configuration, the rotation member 113 for rotating hot air has a plurality of blades and can control the rotation of the hot air depending on the number and the angle of the blades. The hot air supplied to the treatment chamber suitably has a temperature in an outlet portion of the hot air supply means 107 is suitably 100° C. to 300° C. and more suitably 130° C. to 170° C. When the temperature of the hot air is 100° C. or more, the surface roughness of the surface of the toner particle is hard to vary. When the temperature of the hot air is 300° C. or less, the molten state does not excessively progress and the unification of the toner particle does not progress, so that the coarsening and the melt-adhesion of the toner particle are hard to occur. When the temperature in the outlet portion of the hot air supply means is within the ranges mentioned above, the toner particle can be uniformly subjected to spheronization treatment while preventing the melt-adhesion and the unification of the toner particle due to excessively heating the mixture. The hot air is supplied from a hot air supply means outlet 111.

Furthermore, the heat-treated toner particle subjected to the heat treatment is cooled by cold air supplied from a cold air supply means 108. The temperature of the cold air supplied from the cold air supply means 108 is suitably −20° C. to 30° C. When the temperature of the cold air is within the range mentioned above, the heat-treated toner particle can be efficiently cooled and the melt-adhesion and the unification of the heat-treated toner particle can be prevented without inhibiting the uniform spheronization treatment of the mixture. The absolute moisture content of the cold air is suitably 0.5 $g/m^3$ or more and 15.0 $g/m^3$ or less.

Next, the cooled heat-treated toner particles are collected by a collection means 110 provided on the lower end of the treatment chamber. The collection means is provided with a blower (not illustrated) on the tip and is configured so that the toner particle is sucked and conveyed by the blower.

A powder particle supplying outlet 114 is provided so that the rotation direction of the supplied mixture and the rotation direction of the hot air are the same. The collection means 110 of the surface treatment apparatus is provided on an outer peripheral portion of the treatment chamber so that the rotation direction of the rotated powder particle is maintained. Moreover, it is configured so that the cold air supplied from the cold air supply means 108 is supplied in a horizontal and tangential direction from the outer peripheral portion of the treatment chamber to the inner peripheral surface of the treatment chamber. The rotation direction of the toner particle before the heat treatment supplied from the powder particle supplying outlet 114, the rotation direction of the cold air supplied from the cold air supply means 108, and the rotation direction of the hot air supplied from the hot air supply means exit 111 are all the same. Therefore, turbulent flow does not occur in the treatment chamber and the rotation flow in the treatment chamber is strengthened, so that strong centrifugal force is applied to the toner particle before the heat treatment and the dispersibility of the toner particle before the heat treatment further improves. Therefore, the heat-treated toner particle having few unified particles and having a uniform shape can be obtained.

Thereafter, selected external additives, such as an inorganic fine particle and a resin particle, are mixed (externally added) as necessary to thereby increase the fluidity imparting performance and the charge stability, for example, whereby a toner is obtained. The process is performed by a mixing device having a rotating body having a stirring member and a main body casing provided with a gap from the stirring member as a mixing device.

Examples of such a mixing device include, for example,
a Henschel mixer (manufactured by NIPPON COKE &. ENGINEERING CO., LTD.);
a super mixer (manufactured by Kawata Mfg. Co., Ltd.);
a Ribocone (manufactured by Okawara Mfg. Co., Ltd.);
a Nauta mixer, a Turbulizer, a Cyclomix (manufactured by Hosokawa Micron GROUP.);
a Spiral pin mixer (manufactured by Pacific Machinery & Engineering Co., Ltd.);
a Loedige mixer (manufactured by MATSUBO Corporation);
Nobilta (manufactured by Hosokawa Micron GROUP.), and the like.

In particular, in order to perform uniform mixing and to loosen aggregates of the silica particle, a Henschel mixer (manufactured by NIPPON COKE &. ENGINEERING CO., LTD. Industry) is suitably used.

As the mixing device conditions, the processing amount, the number of rotations of a stirring shaft, the stirring time, the stirring blade shape, the temperature in a tank, and the like are mentioned, for example. In order to achieve desired toner performance, the conditions can be set as appropriate in view of the physical properties of the heat-treated toner particle, the type of additives, and the like.

When coarse aggregates of additives are present in a separated state in the obtained toner, for example, a sieving device or the like may be used as necessary.

Next, methods for measuring various physical properties of the toner and the raw materials are described below.

Method for Measuring Peak Molecular Weight (Mp), Number Average Molecular Weight (Mn), and Weight Average Molecular Weight (Mw) of Resin The peak molecular weight (Mp), the number average molecular weight (Mn), and the weight-average molecular weight (Mw) are measured as follows using a gel permeation chromatography (GPC).

First, a sample (resin) is dissolved in tetrahydrofuran (THF) at room temperature over 24 hours. The obtained solution is filtered using a solvent-resistant membrane filter "Maeshori (Pretreatment) Disk" (manufactured by Tosoh Corporation) having a pore diameter of 0.2 μm to give a sample solution. The sample solution is adjusted to have a concentration of a THF-soluble component of about 0.8% by mass. The sample solution is measured under the following conditions.

Apparatus: HLC 8120 GPC (Detector: RI) (manufactured by Tosoh Corporation)
Column: Seven-stage of Shodex KF-801, 802, 803, 804, 805, 806, and 807 (manufactured by Showa Denko K.K.)
Eluate: Tetrahydrofuran (THF)
Flow rate: 1.0 ml/min
Oven temperature: 40.0° C.
Sample Injection Amount: 0.10 ml To calculate the molecular weight of the sample, a molecular weight calibration curve obtained using a standard polystyrene resin is used. As the standard polystyrene resin, the following substances are mentioned, for example.

Mentioned are Trade Name: "TSK standard polystyrene F-850, F-450, F-288, F-128, F-80, F-40, F-20, F-10, F-4, F-2, F-1, A-5000, A-2500, A-1000, and A-500", manufactured by Tosoh Corporation.

Method for Measuring Softening Point of Resin

The softening point of the resin is measured with a constant-load extruding capillary rheometer "Flow characteristic evaluating device Flow Tester CFT-500D" (manufactured by Shimadzu Corporation) in accordance with the manual attached to the device. In this device, a measurement sample charged into a cylinder is melted by raising the temperature while a constant load is applied by a piston from above the measurement sample. The melted measurement sample is extruded from a die at a bottom portion of the cylinder, and then a flow curve showing the relationship between the degree of piston descent and the temperature in this process can be obtained.

In the present application, the softening point is the "Melting temperature according to ½ method" in the manual attached to the "Flow characteristic evaluating device Flow Tester CFT-500D". The "Melting temperature according to ½ method" is calculated as follows.

First, the half of the difference (referred to as X) between the amount of descent of the piston when the outflow stops, Smax and the amount of descent of the piston when the outflow starts, Smin ($X=(Smax-Smin)/2$). Then the temperature in the flow curve when the amount of descent of the piston is X in the flow curve is the melting temperature according to ½ method.

As the measurement sample, a sample is used which is obtained by forming about 1.0 g of resin into a cylindrical shape having a diameter of about 8 mm by being compressed and molded at about 10 MPa for about 60 seconds using a tablet molding compressor (e.g., NT-100H, manufactured by NPA SYSTEM Co., Ltd.), in an environment of a temperature of 25° C.

The measurement conditions of CFT-500D are as follows.
Test mode: Temperature rise method
Starting temperature: 40° C.
Reach temperature: 200° C.
Measurement interval: 1.0° C.
Temperature rise rate: 4.0° C./min
Piston sectional area: 1.000 $cm^2$
Test load (piston load): 10.0 kgf (0.9807 MPa)
Preheating time: 300 seconds
Die hole diameter: 1.0 mm
Die length: 1.0 mm Method for Calculating Toner Average Circularity The average circularity of the toner is measured with a flow-type particle image analyzer "FPIA-3000" (manufactured by Sysmex Corporation) under measurement and analysis conditions in calibration.

The measurement principle of the flow-type particle image analyzer "FPIA-3000" (manufactured by Sysmex Corporation) includes capturing static images of flowing particle, and analyzing the images. A sample added to a sample chamber is supplied to a flat-sheath flow cell by a sample suction syringe. The sample supplied into the flat-sheath flow forms flat flow by being sandwiched between sheath liquids. The sample passing through the inside of the flat-sheath flow cell is irradiated with stroboscopic light at a 1/60 second interval. Thus, images of the flowing particle can be captured as static images. The particle is captured in a focused state because the flow is flat. The particle image is captured by a CCD camera, and the captured image is subjected to image processing at an image processing resolution of 512×512 pixels (0.37 μm×0.37 μm per pixel). The outline of each particle image is extracted, and then a projected area S, a perimeter L, and the like of each particle image are measured.

Next, the circle-equivalent diameter and the circularity are determined using the projected area S and the perimeter L above. The circle-equivalent diameter is defined as the diameter of a circle having the same area as that of the projected area of a particle image and the circularity C is defined as a value obtained by dividing the perimeter of a circle determined from the circle-equivalent diameter by the perimeter of a particle projection image. The circularity is calculated by the following equation. Circularity $C=2\times(\pi\times S)^{1/2}/L$ The circularity when the particle image has a circular shape is 1.000. With an increase in the degree of unevenness of the periphery of the particle image, the value of the circularity is smaller. A value obtained by dividing a circularity range of 0.200 to 1.000 into 800 sections after the calculation of the circularity of each particle, and then calculating the arithmetic mean value of the obtained circularities is defined as the average circularity.

A specific measurement method is as follows.

First, 20 ml of ion exchanged water from which solid impurities and the like are removed beforehand are charged into a glass vessel. Then, 0.2 ml of a diluted solution prepared by three-fold by mass dilution with ion exchanged water of "Contaminon N" (a 10% by mass aqueous solution of a neutral detergent for washing precision instruments containing a nonionic surfactant, an anionic surfactant, and an organic builder and having a pH of 7, manufactured by Wako Pure Chemical Industries, Ltd.) is added as a dispersant into the vessel. Further, 0.02 g of a measurement sample is added to the vessel, and then the mixture is subjected to dispersion treatment using an ultrasonic dispersing unit for 2 minutes to give a dispersion for measurement. The dispersion is cooled as appropriate so that the temperature of the dispersion is in the range of 10° C. or more and 40° C. or less. As the ultrasonic dispersing unit, a desktop ultrasonic cleaning and dispersing unit having an oscillation frequency of 50 kHz and an electrical output of 150 W (e.g., "VS-150" (manufactured by Velvo-Clear)) is used. A predetermined amount of ion exchanged water is charged into a water tank, and then 2 mL of Contaminon N is added to the water tank.

For the measurement, the flow-type particle image analyzer having a standard objective lens (10×) is used and a particle sheath "PSE-900A" (manufactured by Sysmex Corporation) is used as the sheath liquid. The dispersion prepared in accordance with the procedure described above is introduced into the flow-type particle image analyzer, and then the particle diameters of 3,000 toner particles are measured according to a total count mode in an HPF measurement mode. By setting the binarization threshold value in the particle analysis to 85% and limiting the particle diameters to be analyzed to those corresponding to a circle-equivalent diameter in the range of 1.985 μm or more and less than 39.69 μm, the average circularity of the toner is determined.

In the measurement, prior to start of the measurement, automatic focusing is performed by using standard latex particle. Examples of the standard latex particle, the following substances are mentioned, for example.

Mentioned is one obtained by diluting "RESEARCH AND TEST PARTICLES Latex Microsphere Suspensions 5200A" manufactured by Duke Scientific" with ion exchanged water Thereafter, focus adjustment is suitably performed every two hours from the start of the measurement.

In the examples of the present application, a flow-type particle image analyzer calibrated by Sysmex Corporation and granted with a calibration certificate issued by Sysmex Corporation is used. Measurement is performed under the measurement and analysis conditions identical to those when the calibration certificate was granted, except limiting the particle diameters to be analyzed to those corresponding to a circle-equivalent diameter in the range of 1.985 μm or more and less than 39.69 μm.

The average circularity of the toner is suitably less than 0.970 and more suitably less than 0.967.

Method for Measuring Weight Average Particle Diameter (D4) of Toner

The weight average particle diameter (D4) of a toner is calculated as follows.

As a measuring apparatus, a precision particle diameter distribution measuring apparatus employing an aperture impedance method and having a 100 μm aperture tube, "Coulter Counter Multisizer 3" (Registered Trademark, manufactured by Beckman Coulter, Inc.) is used. The setting of measurement conditions and the analysis of measurement data are performed using software, "Beckman Coulter Multisizer 3 Version 3.51" (manufactured by Beckman Coulter, Inc.) attached to the apparatus. The measurement is performed with the number of effective measuring channels set to 25,000.

As an electrolytic aqueous solution to be used for the measurement, one prepared by dissolving special grade sodium chloride in ion exchanged water to a concentration of 1% by mass, for example, "ISOTON II" (manufactured by Beckman Coulter, Inc.) can be used.

The dedicated software is set as described below prior to performing the measurement and the analysis.

In the "Change of standard measurement method (SOM)" screen of the dedicated software, the total count number of a control mode is set to 50,000 particles, the number of measurements is set to 1, and a value obtained by using "Standard particles 10.0 μm" (manufactured by Beckman Coulter, Inc.) is set as a Kd value. A threshold value and a noise level are automatically set by pressing a "Threshold value/Noise level measurement" button. Current is set to 1600 μA, gain is set to 2, electrolyte solution is set to ISOTON II, and a check box for "Flush aperture tube after measurement" is checked.

In the "Setting of conversion from pulse to particle diameter" screen of the dedicated software, a bin interval is set to a logarithmic particle diameter, the number of particle diameter bins is set to 256, and a particle diameter range is set to a range of 2 μm to 60 μm.

A specific measuring method is as follows.

(1) 200 mL of the electrolytic aqueous solution is charged into a 250.0 mL round bottom glass beaker dedicated for the Multisizer 3. The beaker is set in a sample stand, and then the electrolyte solution in the beaker is stirred with a stirrer rod at 24 revolutions/sec in a counterclockwise direction. Then, contamination and air bubbles in the aperture tube are removed using the function of the "Aperture flush" of the dedicated software.

(2) 30 mL of the electrolytic aqueous solution is charged into a 100 ml flat bottom glass beaker. Then, 0.3 mL of a diluted solution prepared by three-fold by mass dilution with ion exchanged water of "Contaminon N" (a 10% by mass aqueous solution of a neutral detergent for washing precision instruments containing a nonionic surfactant, an anionic surfactant, and an organic builder and having a pH of 7, manufactured by Wako Pure Chemical Industries, Ltd.) is added as a dispersant into the beaker.

(3) An ultrasonic dispersing unit "Ultrasonic Dispersion System Tetra 150" (manufactured by Nikkaki Bios Co., Ltd.) having two oscillators having an oscillation frequency of 50 kHz disposed therein in a state where the phases are 180° shifted and having an electrical output of 120 W is prepared. 3.3 L of ion exchanged water is charged into a water tank of the ultrasonic dispersing unit, and then 2 mL of Contaminon N is added into the water tank.

(4) The beaker in (2) above is set in a beaker fixing hole of the ultrasonic dispersing unit, and then the ultrasonic dispersing unit is operated. Then, the height position of the beaker is adjusted in such a manner that the resonance state of the liquid level of the electrolytic aqueous solution in the beaker is the maximum.

(5) 10.0 mg of toner is gradually added to the electrolytic aqueous solution in the beaker of (4) above in a state where the electrolytic aqueous solution is irradiated with ultrasonic waves, and then dispersed. The ultrasonic dispersion treatment is further continued for 60 seconds. The temperature of water in the water tank is adjusted as appropriate so as to be in the range of 10° C. or more and 40° C. or less in ultrasonic dispersion.

(6) The electrolytic aqueous solution in (5) above containing the toner dispersed therein is added dropwise using a pipette onto the round bottom beaker in (1) above placed in the sample stand, and then the concentration of the toner to be measured is adjusted to about 5%. The measurement is performed until the number of measured particles reaches 50,000.

(7) The measurement data is analyzed with the dedicated software attached to the apparatus to calculate the weight average particle diameter (D4). The weight average particle diameter (D4) is the "Average diameter" on an "Analysis/Volume statistics (arithmetic average)" screen of the dedicated software when set to Graph/% by vol with the dedicated software.

Method for Measuring Silica ($SiO_2$) Content in Toner

The measurement of the fluorescent X-rays of each element is performed according to JIS K 0119-1969. A specific measurement method is as follows.

As a measuring apparatus, a wavelength dispersion type fluorescent X-ray analyzer "AXIOS" (manufactured by PANalytical B.V.) and dedicated software attached thereto "Super Q Ver. 4.0F (manufactured by PANalytical B.V.) for setting measurement conditions and analyzing measured data are used. As the anode of an X-ray tube bulb, an Rh anode is used. The measurement atmosphere is vacuum, the measurement diameter (the diameter of a collimator mask) is set to 27 mm, and the measurement time is set to 10 seconds. In measuring light elements, the light elements are detected with a proportional counter (PC). In measuring heavy elements, the heavy elements are detected with a scintillation counter (SC).

As a measurement sample, pellets are used which are obtained by placing about 4 g of a toner in a dedicated aluminum ring for pressing for leveling, and then pressing the same at 20 MPa for 60 seconds using a tablet molding press machine so as to be molded into a size of about 2 mm in thickness and about 39 mm in diameter. As the tablet molding press machine, "BRE-32" (manufactured by Maekawa Testing Machine Mfg. Co., Ltd.) was used.

The measurement is performed under the above-described conditions and the elements are identified based on the obtained X-ray peak positions, whereby the concentration thereof is calculated from the counting rate (unit: cps) which is the number of X-ray photons per unit time.

To 100 parts by mass of a toner particle, a silica ($SiO_2$) fine particle is added so as to give 0.10 part by mass, and then sufficiently mixed using a coffee mill. Similarly, a silica fine particle is mixed with a toner particle so as to give 0.20 part by mass and 0.50 part by mass, and then the mixtures are used as samples for calibration curves.

With respect to each sample, when pellets of each sample for calibration curves are produced as described above using a tablet molding compressor and pentaerythritol (PET) is used for analyzing crystals, the counting rate (unit: cps) of Si-K$\alpha$ rays observed at a diffraction angle ($2\theta$)=109.08° is measured. In the measurement, the acceleration voltage of an X ray generating apparatus and the current value are set to 24 kV and 100 mA, respectively. The vertical axis represents the obtained counting rate of X-rays and the horizontal axis represents the $SiO_2$ addition amount in each sample for calibration curves, whereby a calibration curve of a linear function is obtained.

Next, a toner to be analyzed is formed into pellets using a tablet molding compressor as described above, and then the counting rate of the Si-K$\alpha$ rays thereof is measured. Then, the $SiO_2$ content in the toner is calculated from the calibration curve.

Method for Measuring Aluminum Content in Silica Particle

The measurement of fluorescent X-rays of each element is performed according to JIS K 0119-1969. A specific method is as follows.

As a measuring apparatus, a wavelength dispersion type fluorescent X-ray analyzer "AXIOS" (manufactured by PANalytical B.V.) and dedicated software attached thereto "Super Q Ver. 4.0F (manufactured by PANalytical B.V.) for setting measurement conditions and analyzing measured data are used. As the anode of an X-ray tube bulb, an Rh anode is used. The measurement atmosphere is vacuum, the measurement diameter (the diameter of a collimator mask) is set to 27 mm, and the measurement time is set to 10 seconds. In measuring light elements, the light elements are detected with a proportional counter (PC). In measuring heavy elements, the heavy elements are detected with a scintillation counter (SC).

As a measurement sample, pellets are used which are obtained by placing about 4 g of a toner in a dedicated aluminum ring for pressing for leveling, and then pressing the same at 20 MPa for 60 seconds using a tablet molding compressor so as to be molded into a size of about 2 mm in thickness and about 39 mm in diameter. As the tablet molding compressor, "BRE-32" (manufactured by Maekawa Testing Machine Mfg. Co., Ltd.) was used.

The measurement is performed under the above-described conditions and the elements are identified based on the obtained X-ray peak positions, whereby the concentration thereof is calculated from the counting rate (unit: cps) which is the number of X-ray photons per unit time.

To 100 parts by mass of polyester, alumina fine particle is added so as to give 0.10 part by mass, and then sufficiently mixed using a coffee mill. Similarly, alumina fine particle is mixed with polyester so as to give 0.20 part by mass and 0.50 part by mass, and then the mixtures are used as samples for calibration curves.

With respect to each sample, when pellets of each sample for calibration curves are produced as described above using the tablet molding compressor and PET is used for analyzing crystals, the counting rate (unit: cps) of Al-K$\alpha$ rays observed at a diffraction angle ($2\theta$)=144.82° is measured. In the measurement, the acceleration voltage of an X ray generating apparatus and the current value are set to 24 kV and 160 mA, respectively. The vertical axis represents the obtained counting rate of X-rays the and the horizontal axis represents the addition amount of the alumina fine particle in each sample for calibration curves, whereby a calibration curve of a linear function is obtained. Next, a silica particle to be analyzed is formed into pellets using a tablet molding compressor as described above, and then the counting rate of the Al-K$\alpha$ rays thereof is measured. Then, the content of the aluminum in the silica particle is calculated from the calibration curve.

Method for Measuring BET Specific Surface Area of Silica Particle

The BET specific surface area of the silica particle is measured according to JIS 28830 (2001). A specific measurement method is as follows.

As a measuring apparatus, an "Automatic specific surface area/pore distribution measuring apparatus TriStar 3000 (manufactured by Shimadzu Corporation)" employing a gas adsorption method according to a constant-volume method as the measurement method. Setting of measurement conditions and analysis of measurement data are performed using dedicated software "TriStar 3000 Version 4.00" attached to the device. A vacuum pump, nitrogen gas piping, and helium gas piping are connected to the device. Nitrogen gas is used as adsorption gas. A value calculated by the BET multi-point method is defined as the BET specific surface area.

The BET specific surface area is calculated as follows.

First, the silica particle is caused to adsorb nitrogen gas, and then the equilibrium pressure P (Pa) in a sample cell and the amount of nitrogen adsorption Va ($mol \cdot g^{-1}$) of the silica particle at that time are measured. Then, an adsorption isotherm is obtained in which the horizontal axis represents the relative pressure Pr as a value obtained by dividing the equilibrium pressure P (Pa) in the sample cell by the saturated vapor pressure Po (Pa) of nitrogen and the vertical axis represents the amount of nitrogen adsorption Va ($mol \cdot g^{-1}$). Next, a monomolecular layer adsorption amount Vm ($mol \cdot g^{-1}$) as the adsorption amount required for the formation of a monomolecular layer on the surface of the silica particle is determined using the BET equation shown below.

$$Pr/Va(1-Pr)=1/(Vm\times C)+(C^{-1})\times Pr/(Vm\times C)$$

In the equation, C represents the BET parameter and is a variable which varies depending on the type of the measurement sample, the type of the adsorption gas, and the adsorption temperature.

The BET equation can be interpreted as a straight line having a slope of (C−1)/(Vm×C) and an intercept of 1/(Vm×C), in which the X-axis represents Pr and the Y-axis represents Pr/Va(1−Pr) (the straight line is referred to as a "BET plot").

$$\text{Slope of straight line}=(C-1)/(Vm\times C)$$

$$\text{Straight line intercept}=1/(Vm\times C)$$

Actual measurement values for Pr and actual measurement values for Pr/Va (1−Pr) are plotted on a graph, and a straight line is drawn by a least-square method, which allows calculation of the straight line slope and the intercept value. Vm and C can be calculated by solving the above simultaneous equations for the slope and the intercept using the values above.

Further, the BET specific surface area S ($m^2 \cdot g^{-1}$) of the silica particle is calculated from the Vm calculated above and the molecule-occupied sectional area (0.162 $nm^2$) of nitrogen molecules based on the following equation.

$$S=Vm\times N\times 0.162\times 10^{-18}$$

In the equation, N represents Avogadro's number ($mol^{-1}$).

The measurement using the apparatus is performed according to "TriStar3000 Instruction Manual V 4.0" attached to the apparatus. Specifically, the measurement is performed according to the following procedure.

The tare of a dedicated glass sample cell (having a stem diameter of ⅜ inch and a volume of about 5 ml) which has been sufficiently washed and dried is precisely weighed. Then, about 0.3 g of the silica particle is charged into the sample cell using a funnel.

The sample cell containing the silica particle is set in a "Maeshori (Pretreatment) apparatus VacuPrep 061 (manufactured by Shimadzu Corporation)" to which a vacuum pump and nitrogen gas piping are connected, and then vacuum degassing is continued at 23° C. for about 10 hours. In the vacuum degassing, degassing is gradually performed while adjusting a valve in such a manner that the silica particle is not sucked by the vacuum pump. The pressure in the cell gradually decreases with the progress of the degassing to finally reach about 0.4 Pa (about 3 mTorr). After the vacuum degassing is completed, nitrogen gas is gradually injected thereinto to return the pressure in the sample cell to atmospheric pressure, and then the sample cell is removed from the Maeshori (Pretreatment) apparatus. Then, the mass of the sample cell is precisely weighed, and the accurate mass of the silica particle is calculated based on a difference between the tare and the mass. The sample cell is capped with a rubber stopper during the weighing in such a manner that the silica particle in the sample cell is not contaminated with moisture and the like in air.

Next, a dedicated "isothermal jacket" is attached to a stem portion of the sample cell containing the silica particle. A dedicated filler rod is inserted into the sample cell, and the sample cell is set in an analysis port of the apparatus. The isothermal jacket is a tubular member capable of sucking up liquid nitrogen to a given level by capillarity and having an inner surface containing a porous material and an outer surface containing an impermeable material.

Subsequently, the free space of the sample cell including a connection fixture is measured. With respect to the free space, the volume of the sample cell is measured using helium gas at 23° C. Then, the volume of the sample cell is measured using helium gas in the same manner as the above after cooling the sample cell in liquid nitrogen. The free space is calculated based on a difference between the volumes. The saturated vapor pressure Po (Pa) of nitrogen is separately and automatically measured using a Po tube disposed in the apparatus.

Next, the interior of the sample cell is vacuum-degassed, and then the sample cell is cooled in liquid nitrogen while vacuum degassing is continued. Thereafter, nitrogen gas is introduced into the sample cell in a stepwise manner so that the nitrogen molecules are adsorbed to the silica particle. Herein, the adsorption isotherm described above can be obtained by measuring the equilibrium pressure P (Pa) at an arbitrary time. Therefore, the adsorption isotherm is converted to a BET plot. Points of relative pressure Pr at which data are collected are set to six points in total, i.e., 0.05, 0.10, 0.15, 0.20, 0.25 and 0.30. A straight line is drawn for the obtained measurement data by a least-square method, and then Vm is calculated from the slope and the intercept of the straight line. The BET specific surface area of the silica particle is calculated using the Vm value as described above.

The silica particle for use in the toner has a specific surface area of suitably 5 $m^2/g$ or more and 50 $m^2/g$ or less and more suitably 15 $m^2/g$ or more and 35 $m^2/g$ or less.

Method for Measuring Shape Factor SF-1

Using a transmission electron microscope H-7500 (manufactured by Hitachi), the silica particle is observed at an acceleration voltage of 100 kV, and then an enlarged photograph of the cross section of the silica particle is taken. The magnification of the enlarged photograph is set to 1,000 times and five images in which 100 to 200 silica particles are present in one visual field are randomly selected. All the silica particles present in the randomly selected five images are determined for the shape factor SF-1 by the following method. With respect to the SF-1 showing the shape factor, the images are introduced into an image analyzer (LuzexIII) manufactured by NIRECO through an interface, and then analyzed. Then, a value obtained by calculation by the following equation is defined as the shape factor SF-1. The shape factor SF-1 shows the degree of roundness of particles.

$$\text{Shape factor SF-1}=(\text{MAXLNG})^2/\text{AREA}\times\pi/4\times 100$$

In the equation, MAXLNG represents the absolute maximum length of particle and AREA represents the projected area of particle. The silica particle for use in the toner has a shape factor SF-1 of suitably 135 or more and less than 180 and more suitably 150 or more and less than 165. When the shape factor SF-1 is 135 or more, stress due to contact with a carrier or other charge imparting members is small, the stable chargeability is easily maintained, and fogging and image density changes are hard to occur. On the other hand, when the shape factor SF-1 is less than 180, the contact surface of the silica particle with the surface of the toner particle is sufficient, the chargeability easily improves, and image density changes are hard to occur.

Method for Measuring Coverage

The coverage is calculated by analyzing images of the surface of the toner particle captured by an ultra-high resolution scanning electron microscope S-4800 (manufactured by Hitachi High-Technologies Corp.) with image analysis software Image-Pro Plus ver. 5.0 (manufactured by NIPPON ROPER K.K.). The image capturing conditions of S-4800 are as follows.

(1) Sample Production

A conductive paste is thinly applied to a sample stand (15 mm×6 mm aluminum sample stand), and then a toner is sprayed onto the sample stand. Furthermore, air is blown to remove excessive toner from the sample stand, and then the sample stand is sufficiently dried. The sample stand is set on a sample holder, and then the sample stand height is adjusted to 36 mm by a sample height gauge.

(2) Setting of S-4800 Observation Conditions

The calculation of the coverage X is performed using images obtained by observation of reflection electron images by S-4800. The reflection electron image has less charge-up of an inorganic fine particle as compared with secondary electron images, and therefore the coverage X can be measured with good accuracy. When measuring the coverage X, the measurement is performed after performing element analysis by an energy dispersion type X-ray analyzer (EDAX) beforehand, and then removing particle other than the silica particle on the surface of the toner particle.

Liquid nitrogen is injected into an anticontamination trap attached to a mirror body of S-4800 until the liquid nitrogen overflows, and then the anticontamination trap is held for 30 minutes. "PC-SEM" of S-4800 is started, and flushing (cleaning of FE chip as an electron source) is performed. An acceleration voltage display portion of a control panel on a screen is clicked, and then a [Flushing] button is pressed to open a flushing execution dialog. After confirming that the flushing strength is 2, the flushing is executed. It is confirmed that the emission current by the flushing is 20 to 40 μA. A sample holder is inserted into a sample chamber of the mirror body of S-4800. A [Start point] on a control panel is pressed to move the sample holder to an observation position.

The acceleration voltage display portion is clicked to open an HV setting dialog, and then setting the acceleration voltage to [0.8 kV] and the emission current to [20 μA]. In a [Basics] tab of an operation panel, signal selection is set to [SE], [Upper (U)] and [+BSE] are selected for an SE detector, and [L.A.100] is selected in a selection box on the right of [+BSE], whereby the mode is set to an observation mode with a reflection electron image. In the same [Basics] tab of the operation panel, the probe current of an electron optical system condition block is set to [Normal], the focus mode is set to [UHR], and WD is set to [3.0 mm]. An [ON] button in the acceleration voltage display portion of the control panel is pressed to apply the acceleration voltage.

(3) Focus Adjustment

A focus knob [COARSE] of the operation panel is rotated, and then aperture alignment is adjusted at a point where focus is achieved to some extent. [Align] of the control panel is clicked to display an alignment dialog, and then [Beam] is selected. A STIGMA/ALIGNMENT knob (X, Y) of the operation panel is rotated to move a beam to be displayed to the center of concentric circles. Next, [Aperture] is selected, the STIGMA/ALIGNMENT knob (X, Y) is rotated in increments of 1 to perform focusing so that the movement of an image is stopped or minimized. The aperture dialog is closed, and then focus is achieved using autofocus. Thereafter, the magnification is set to 50,000 (50 k) time, and then focus adjustment is performed using the focus knob and the STIGMA/ALIGNMENT knob in the same manner as the case described above to achieve focus using autofocus. This operation is repeated again to achieve focus. Herein, when the tilt angle of the observation surface is large, the measurement accuracy of the coverage is likely to be low. Therefore, by selecting a toner particle in which the entire surface to be observed is simultaneously brought into focus in the focus adjustment, a toner particle having a surface having as small a tilt as possible is selected and analyzed.

(4) Image Storage

Brightness adjustment is performed using an ABC mode, and then a photograph is taken with a size of 640×480 pixels and stored. The following analysis is performed using an image file. One photograph is taken for one toner particle, and then images of at least about 30 or more toner particles are obtained.

(5) Image Analysis

The coverage is calculated by subjecting the images obtained by the technique described above to binarization treatment using the following analysis software. Herein, the one screen is divided into 12 squares, and then each square is analyzed. The analysis conditions of the image analysis software Image-ProPlus ver. 5.0 are as follows.

Software: Image-ProPlus 5.1J

From "Measurement" of a tool bar, "Count/Size" and "Options" are selected in order, and then binarization conditions are set. "8-connect" is selected in an object extraction option, and Smoothing is set to 0. As options, "Pre-Filter", "Fill holes", and "Convex hull" are not selected, and "Clean borders" is set to "None". A "Select Measurements" is selected from "Measure" of the tool bar, and then 2 to 107 are input into the area screening range.

The calculation of the coverage is performed by surrounding a square area. Herein, the surrounding is performed so that an area (C) of the area is set to 24,000 to 26,000 pixels. Automatic binarization is performed by "Processing"-Binarization, and then the total area (D) of the silica particle-free areas is calculated.

The coverage is determined by the following equation from the area C of the square area and the total area D of the silica particle-free areas.

$$\text{Coverage}(\%)=100-(D/C\times 100)$$

The average value of all the obtained data is defined as the coverage in the present disclosure.

The toner suitably has a coverage with the silica particle of the surface of the toner particle of suitably 30% or more and 90% or less and more suitably 50% or more and 80% or less.

Method for Measuring a Sticking Ratio

The sticking ratio is usually calculated from the amount of the silica particle in the toner in a normal state and the amount of the silica particle remaining after removing the silica particle not stuck to the surface of the toner particle.

The removal of the silica particle not stuck to the surface of the toner particle is performed as follows.

160 g of sucrose is added to 100 mL of ion exchanged water, and then dissolved with hot water to prepare a sucrose solution. A solution prepared by adding 23 mL of the sucrose solution and 6.0 mL of nonionic surfactant, suitably Contaminon N (manufactured by Wako Pure Chemical Industries: Trade Name) is charged into a 50 mL polyethylene sealable sample bottle, 1.0 g of a measurement sample is added thereto, and then the sample bottle is sealed. The sealed vessel is lightly shaken for stirring, and then allowed to stand still for 1 hour. The sample allowed to stand still for 1 hour is shaken at 350 spm for 20 minutes with a KM shaker (Trade Name, manufactured by IWAKI CO., LTD.). Herein, when the right above (vertical) position of the shaker is 0°, the shaking angle is set so that a shaking strut moves forward by 15° and backward by 20°. The sample bottle is fixed to a fixing holder (one in which a lid of the sample bottle is fixed to the extension of the center of the strut) attached to the tip of the strut. The shaken sample is promptly transferred into a vessel for centrifugal separation. The sample transferred into the vessel for centrifugal separation is centrifuged with a high speed cooling centrifuge H-9R (manufactured by Kokusan Co., Ltd.: Trade Name) under the conditions of a set temperature of 20° C., the shortest acceleration/deceleration time, a number of rotations of 3,500 rpm, and a rotation time of 30 minutes. The toner separated at the topmost portion is collected, filtered with a vacuum filter, and then dried with a drier for 1 hour or more.

The sticking ratio is calculated by the following equation.

$$\text{Sticking ratio}(A)=\{1-(P1-P2)/P1\}\times 100$$

In the equation, P1 represents the $SiO_2$ amount ("% by mass") of the initial toner and P2 represents the $SiO_2$ amount ("% by mass") of the toner after the removal of the silica particle not stuck to the surface of the toner particle by the above-described technique. The $SiO_2$ amount of the toner is calculated by drawing a calibration curve from the $SiO_2$ intensity of the toner determined by XRF (fluorescent X-rays) measurement.

In the toner, the sticking ratio to the surface of the toner particle of the silica particle is suitably 50% by mass or more and 100% by mass or less and more suitably 70% by mass or more and 100% by mass or less.

Toner Manufacturing Example

Production Example of Binding Resin 1

76.9 parts by mass (0.167 mol) of polyoxypropylene(2,2)-2,2-bis(4-hydroxyphenyl)propane, 24.1 parts by mass (0.145 mol) of terephthalic acid, 8.0 parts by mass (0.054 mol) of adipic acid, and 0.5 part by mass of titanium tetrabutoxide were charged into a 4 L four-necked glass flask. A thermometer, a stirring rod, a condenser, and a nitrogen introduction tube were attached to the flask, and then the flask was placed in a mantle heater. Next, the interior of the flask was purged with nitrogen gas, the temperature in the flask was gradually raised under stirring, and then the reaction was allowed to proceed for 4 hours under stirring at a temperature of 200° C. (First reaction process). Thereafter, 1.2 parts by mass (0.006 mol) of trimellitic anhydride was added, and then the reaction was allowed to proceed for 1 hour at a temperature of 180° C. (Second reaction proceed) to give a binding resin 1.

The acid value of the binding resin 1 was 5 mgKOH/g and the hydroxyl value thereof was 65 mgKOH/g. The GPC molecular weights were a weight-average molecular weight (Mw) of 8,000, a number average molecular weight (Mn) of 3,500, and a peak molecular weight (Mp) of 5,700. The softening point was 90° C.

Production Example of Binding Resin 2

71.3 parts by mass (0.155 mol) of polyoxypropylene(2,2)-2,2-bis(4-hydroxyphenyl)propane, 24.1 parts by mass (0.145 mol) of terephthalic acid, and 0.6 part by mass of titanium tetrabutoxide The materials above were charged into a 4 L four-necked glass flask. A thermometer, a stirring rod, a condenser, and a nitrogen introduction tube were attached to the flask, and then the flask was placed in a mantle heater. Next, the interior of the flask was replaced with nitrogen gas, the temperature in the flask was gradually raised under stirring, and then the reaction was allowed to proceed for 2 hours under stirring at a temperature of 200° C. (First reaction process). Thereafter, 5.8 parts by mass (0.030 mol) of trimellitic anhydride was added, and then the reaction was allowed to proceed for 10 hour at a temperature of 180° C. (Second reaction process) to give a binding resin 2.

The acid value of the binding resin 2 was 15 mgKOH/g and the hydroxyl group value was 7 mgKOH/g. The GPC molecular weights were a weight average molecular weight (Mw) of 200,000, a number average molecular weight (Mn) of 5,000, and a peak molecular weight (Mp) of 10,000. The softening point was 130° C.

Production Example of Silica Particle 1

1,000 g of sodium silicate ($SiO_2$: 29.0% by mass, $Na_2O$: 9.7% by mass, $H_2O$: 61.3% by mass) was added to 5,450 g of deionized water, and then uniformly mixed to produce diluted sodium silicate containing 4.5% by mass of $SiO_2$. The diluted sodium silicate was allowed to pass through a column of an H type strongly acidic cation exchange resin regenerated beforehand by hydrochloric acid for dealkalization to give 7,250 g of active silica having a silica concentration of 3.8% by mass and a pH of 2.9. 10% by mass of NaOH was added to part (330 g) of the active silica under stirring to set the pH to 8.0, the mixture was heated to 95° C., and then the temperature was maintained for 1 hour. Thereafter, the remaining (6,920 g) active silica was added over 8 hours. During the addition, 10% by mass of NaOH was added every 30 minutes so that 95° C. was maintained and the pH of 10 was maintained. After the completion of the addition of the active silica, the temperature was maintained at 95° C. for 1 hour. Thus, primary particle of colloidal silica was formed. The colloid liquid exhibited a pale hue and was transparent. Subsequently, 1N—HCl was added dropwise to set the pH to 8.5, and then 250 g of an aqueous polyaluminum chloride solution (polyaluminum chloride solution diluted by 10 times) having a concentration of 1% by mass was added as a flocculating agent. By the addition, the white color of the colloid liquid became deep and the colloid liquid became translucent.

Next, 10% by mass of NaOH was added to the colloid liquid under stirring to return the pH to 10, and then 2,000 g of active silica was added again over 2 hours. During the addition, 10% by mass of NaOH was added every 30 minutes so that 95° C. was maintained and the pH of 10 was maintained. Also after the completion of the addition, the mixture was heated to 95° C., the temperature was maintained for 1 hour, and then the mixture was allowed to be cooled to 50° C. Next, pressure filtration by pump circulation liquid feed was performed using a hollow fiber ultrafiltration membrane to condense the silica concentration to 30%. Thus, aggregated silica particles were unified to give silica particle 1. The physical properties of the obtained silica particle 1 are shown in Table 1.

Production Example of Silica Particle 2

Silica particle 2 was obtained in the same manner as in the production example of silica particle 1, except using aluminum nitrate as the flocculating agent. The physical properties of the obtained silica particle 2 are shown in Table 1.

Production Example of Silica Particle 3

Silica particle 3 was obtained in the same manner as in the production example of silica particle 1, except using aluminum chloride as the flocculating agent. The physical properties of the obtained silica particle 3 are shown in Table 1.

Production Example of Silica Particle 4

Silica particle 4 was obtained in the same manner as in the production example of silica particle 1, except using aluminum hydroxide as the flocculating agent. The physical properties of the obtained silica particle 4 are shown in Table 1.

Production Example of Silica Particle 5 to 15

Silica particle 5 to 15 were obtained in the same manner as in the production example of silica particle 3, except changing the addition amount of the aluminum chloride. The physical properties of the obtained silica particle 5 to 15 are shown in Table 1.

Production Example of Silica Particle 16

1,000 g of sodium silicate ($SiO_2$: 29.0% by mass, $Na_2O$: 9.7% by mass, $H_2O$: 61.3% by mass) was added to 5,450 g of deionized water, and then uniformly mixed to produce diluted sodium silicate containing 4.5% by mass of $SiO_2$. The diluted sodium silicate was allowed to pass through a column of an H type strongly acidic cation exchange resin regenerated beforehand by hydrochloric acid for dealkalization to give 7,250 g of active silica having a silica concentration of 3.8% by mass and a pH of 2.9. 10% by mass of NaOH was added to part (330 g) of the active silica under stirring to set the pH to 8.0, the mixture was heated to 95° C., and then the temperature was maintained for 1 hour. Thereafter, the remaining (6,920 g) active silica was added over 8 hours. During the addition, 10% by mass of NaOH was added every 30 minutes so that 95° C. was maintained and the pH of 10 was maintained. After the completion of the addition of the active silica, the temperature was maintained at 95° C. for 1 hour. Thus, primary particle of colloidal silica was formed. The colloid liquid exhibited a pale hue and was transparent. Subsequently, 1N—HCl was added dropwise to set the pH to 8.5, and then 250 g of aluminum oxide having a concentration of 10% by mass was added. The appearance of the colloid liquid did not change and the colloid liquid exhibited a pale hue and was transparent.

Next, 10% by mass of NaOH was added to the colloid liquid under stirring to return the pH to 10, and then 2,000 g of active silica was added again over 2 hours. During the addition, 10% by mass of NaOH was added every 30 minutes so that 95° C. was maintained and the pH of 10 was maintained. Also after the completion of the addition, the mixture was heated to 95° C., the temperature was maintained for 1 hour, and then the mixture was allowed to be cooled to 50° C. Next, pressure filtration by a pump circulation liquid feed was performed using a hollow fiber ultrafiltration membrane to condense the silica concentration to 30%, whereby silica particle 16 was obtained. The physical properties of the obtained silica particle 16 are shown in Table 1.

Production Example of Silica Particle 17 and 18

Silica particle 17 and 18 were obtained in the same manner as in the production example of silica particle 16, except changing the addition amount of the aluminum oxide. The physical properties of the obtained silica particle 17 and 18 are shown in Table 1.

Production Example of Silica Particle 19

10 parts by mass of methylethoxysilane was added as a silane-based treatment agent to 100 parts by mass of a silica sol suspension obtained by subjecting alkoxysilane to hydrolysis and condensation reaction in an organic solvent in which water was present with a catalyst to generate secondary aggregated particle. 99.6% by mass of the secondary aggregated particle obtained by solvent-removal and drying was surface treated with 0.4% by mass of hexamethyldisilazane to give silica particle 19. The physical properties of the obtained silica particle 19 are shown in Table 1.

Production Example of Silica Particle 20

For the production of silica particle 20, a hydrocarbon-oxygen mixing burner having a double tube structure capable of forming inner flame and outer flame was used as a combustion furnace. A two-fluid nozzle for spraying slurry is set at a center portion of the burner to introduce a silicon compound as a raw material. An inflammable gas of hydrocarbon-oxygen is sprayed from the periphery of the two-fluid nozzle to form inner flame and outer flame serving as a reduction atmosphere. The amounts and the flow rates of the inflammable gas and oxygen are controlled to adjust the atmosphere, the temperature, the length of each flame, and the like. Silica fine particle is formed from a silicon compound in the flames, and are fused until the particle has a desired particle diameter. Thereafter, the particle is cooled, and then collected by a bag filter or the like, whereby the silica fine particle is obtained. Hexamethylcyclotrisiloxane was used as the silicon compound as the raw material to produce particle, and then 99.6% by mass of the obtained silica particle was surface-treated with 0.4% by mass of hexamethyldisilazane to obtain silica particle 20. The physical properties of the obtained silica particle 20 are shown in Table 1.

Production Example of Silica Particle 21 and 22

Silica particle 21 and 22 were obtained in the same manner as in the production example of silica particle 4, except changing the addition amount of the aluminum hydroxide as shown in Table 1. The physical properties of the obtained silica particle 21 and 22 are shown in Table 1.

Production Example of Silica Particle 23

Into a 3 L glass reactor having a stirring machine, a dropping funnel, and a thermometer, 687.9 g of methanol, 42.0 g of pure water, and 47.1 g of 28% by mass ammonia water were charged, followed by mixing. The obtained solution was adjusted to 35° C., and then 1,100.0 g (7.23 mol) of tetramethoxysilane and 395.2 g of 5.4% by mass ammonia water were simultaneously added. The tetramethoxysilane and the ammonia water were added dropwise over 5 hours and 4 hours, respectively. Even after the completion of the dropwise addition, the stirring was further continued for 0.2 hour to perform hydrolysis. Thus, a methanol-water dispersion of hydrophilic spherical silica fine particle was obtained. Subsequently, an ester adapter and a cooling tube were attached to the glass reactor, and the dispersion was heated to 65° C. to distill off the methanol. Thereafter, pure water was added thereto in the same amount as that of the distilled-off methanol. This dispersion was sufficiently dried under reduced pressure at a temperature of 80° C. The obtained silica particle was heated at 400° C. for 10 minutes in a thermostat bath. The process above was carried out 20 times. The obtained silica particle was subjected to cracking treatment using a pulverizer (manufactured by Hosokawa Micron Group).

Thereafter, 500 g of the silica particle was charged into a polytetrafluoroethylene inner cylinder-type autoclave having an internal volume of 1,000 mL. The interior of the autoclave was purged with nitrogen gas. Thereafter, while a stirring blade attached to the autoclave was rotated at 400 rpm, 0.5 g of hexamethyldisilazane (HMDS) and 0.1 g of water were nebulized in a two-fluid nozzle and uniformly sprayed onto the silica particle. After stirring for 30 minutes, the autoclave was sealed and heated at 200° C. for 2 hours. Subsequently, the pressure in the system was reduced under heating for deammoniation to obtain silica particle 23. The physical properties of the silica fine particle 23 are shown in Table 1.

TABLE 1

| | Aluminum additive | Addition amount (ppm) | Shape factor SF-1 | Specific surface area ($m^2/g$) |
|---|---|---|---|---|
| Silica particle 1 | Polyaluminum chloride | 5.00 | 160 | 25 |
| Silica particle 2 | Aluminum sulfate | 5.00 | 160 | 25 |
| Silica particle 3 | Aluminum chloride | 5.00 | 160 | 25 |
| Silica particle 4 | Aluminum hydroxide | 5.00 | 160 | 25 |
| Silica particle 5 | Aluminum chloride | 6.00 | 160 | 25 |
| Silica particle 6 | Aluminum chloride | 6.30 | 165 | 13 |
| Silica particle 7 | Aluminum chloride | 3.80 | 157 | 42 |
| Silica particle 8 | Aluminum chloride | 7.00 | 173 | 6 |
| Silica particle 9 | Aluminum chloride | 3.30 | 159 | 50 |
| Silica particle 10 | Aluminum chloride | 10.00 | 140 | 3 |
| Silica particle 11 | Aluminum chloride | 8.40 | 170 | 60 |
| Silica particle 12 | Aluminum chloride | 5.50 | 135 | 60 |
| Silica particle 13 | Aluminum chloride | 7.60 | 178 | 60 |
| Silica particle 14 | Aluminum chloride | 3.00 | 120 | 60 |
| Silica particle 15 | Aluminum chloride | 0.70 | 200 | 60 |
| Silica particle 16 | Aluminum oxide | 100.00 | 120 | 60 |
| Silica particle 17 | Aluminum oxide | 0.20 | 120 | 60 |
| Silica particle 18 | Aluminum oxide | 190.00 | 120 | 60 |
| Silica particle 19 | — | — | 135 | 50 |
| Silica particle 20 | — | — | 137 | 50 |
| Silica particle 21 | Aluminum hydroxide | 250.00 | 178 | 18 |
| Silica particle 22 | Aluminum hydroxide | 0.10 | 135 | 50 |
| Silica particle 23 | — | — | 120 | 25 |

Production Example of Toner 1

Binding resin 1: 50.0 parts by mass

Binding resin 2: 50.0 parts by mass

Fischer-Tropsch wax (Peak temperature of maximum endothermic peak: 76° C.): 6.0 parts by mass C.I. Pigment Blue 15:3: 5.0 parts by mass Aluminum compound of 3,5-di-t-butylsalicylic acid: 0.5 part by mass The materials above were mixed using a Henschel mixer (FM-75 model, manufactured by NIPPON COKE &. ENGINEERING CO., LTD.) at a number of rotations of 20 $s^{-1}$ and a rotation time of 5 minutes, and thereafter the resulting mixture was kneaded in a biaxial kneader (PCM-30 model, manufactured by Ikegai, Ltd.) at a temperature set to 125° C. The obtained kneaded product was cooled, and then coarsely pulverized into a size of 1 mm or less with a hammer mill, whereby a coarsely pulverized product was obtained. The obtained coarsely pulverized product was finely pulverized with a mechanical type pulverizer (T-250, manufactured by FREUND TURBO). The resultant product was classified by using a rotary classifier (200TSP, manufactured by Hosokawa Micron Group) to give toner particle. The classification was performed under the operation conditions of the rotary classifier (200TSP, manufactured by Hosokawa Micron Group) of the number of rotations of a motor of 50.0 $s^{-1}$. The weight average particle diameter (D4) of the obtained toner particle was 5.9 μm.

To 100 parts by mass of the obtained toner particle, 5.0 parts by mass of the silica particle 1 were added, mixed in a Henschel mixer (FM-75 Model, manufactured by NIPPON COKE &. ENGINEERING CO., LTD.) at a number of rotations of 30 $s^{-1}$ and a rotation time of 10 minutes, and then subjected to heat treatment in a surface treatment apparatus illustrated in FIGURE. The operation conditions were as follows: Feed rate=5 kg/hr, Hot air temperature C=150° C., Hot air flow rate=6 $m^3$/min, Cold air temperature E=5° C., Cold air flow rate=4 $m^3$/min, Cold air absolute moisture content=3 g/$m^3$, Blower airflow=20 $m^3$/min, and Injection air flow rate=1 $m^3$/min.

To 100 parts by mass of the obtained treated toner particle, the following materials were added, and then mixed in a Henschel mixer (FM-75 Model, manufactured by NIPPON COKE &. ENGINEERING CO., LTD.) at a number of rotations of 30 $s^{-1}$ and a rotation time of 10 minutes to give a toner 1. Hydrophobic silica fine particle having a specific surface area of 90 $m^2/g$ subjected to surface treatment with 20% by mass of hexamethyldisilazane: 0.8 part by mass; and Titanium oxide fine particle having a specific surface area of 30 $m^2/g$ subjected to surface treatment with 16% by mass of isobutyltrimethoxysilane: 0.2 part by mass The average circularity and the weight average particle diameter (D4) of the obtained toner 1 were 0.960 and 6.2 μm, respectively. The physical properties of the obtained toner 1 are shown in Table 2.

Production Example of Toner 2

Binding resin 1: 50.0 parts by mass

Binding resin 2: 50.0 parts by mass

Fischer-Tropsch wax (Peak temperature of maximum endothermic peak: 76° C.): 6.0 parts by mass C.I. Pigment Blue 15:3: 5.0 parts by mass Aluminum compound of 3,5-di-t-butylsalicylic acid: 0.5 part by mass The materials above were mixed using a Henschel mixer (FM-75 model, manufactured by NIPPON COKE &. ENGINEERING CO., LTD.) at a number of rotations of 20 $s^{-1}$ and a rotation time of 5 minutes, and thereafter the resulting mixture was kneaded in a biaxial kneader (PCM-30 model, manufactured by Ikegai, Ltd.) at a temperature set to 125° C. The obtained kneaded product was cooled, and then coarsely pulverized into a size of 1 mm or less with a hammer mill, whereby a coarsely pulverized product was obtained. The obtained coarsely pulverized product was finely pulverized with a mechanical type pulverizer (T-250, manufactured by FREUND TURBO). The resultant product was classified by using a rotary classifier (200TSP, manufactured by Hosokawa Micron Group) to give toner particle. The classification was performed under the operation conditions of the rotary classifier (200TSP, manufactured by Hosokawa Micron Group) of the number of rotations of a motor of 50.0 $s^{-1}$. The weight average particle diameter (D4) of the obtained toner particle was 5.7 μm.

To 100 parts by mass of the obtained treated toner particle, the following materials were added, and then mixed in a Henschel mixer (FM-75 Model, manufactured by NIPPON COKE &. ENGINEERING CO., LTD.) at a number of rotations of 60 $s^{-1}$ for a rotation time of 20 minutes to give a toner 2.

Silica particle 1: 5.0 parts by mass;

Hydrophobic silica fine particle having a specific surface area of 90 $m^2/g$ subjected to surface treatment with 20% by mass of hexamethyldisilazane: 0.8 part by mass; and Titanium oxide fine particle having a specific surface area of 30 $m^2/g$ subjected to surface treatment with 16% by mass of isobutyltrimethoxysilane: 0.2 part by mass The average circularity and the weight average particle diameter (D4) of the obtained toner 2 were 0.955 and 6.0 μm, respectively. The physical properties of the obtained toner 1 are shown in Table 2.

Production Example of Toners 3 to 5

Toners 3 to 5 were obtained in the same manner as in the production example of toner 1, except changing the hot air temperature of the surface treatment apparatus as shown in Table 2. The physical properties of the obtained toners 3 to 5 are shown in Table 2.

Production Example of Toner 6

Binding resin 1: 50.0 parts by mass

Binding resin 2: 50.0 parts by mass

Fischer-Tropsch wax (Peak temperature of maximum endothermic peak: 76° C.): 6.0 parts by mass C.I. Pigment Blue 15:3: 5.0 parts by mass Aluminum compound of 3,5-di-t-butylsalicylic acid: 0.5 part by mass The materials above were mixed using a Henschel mixer (FM-75 model, manufactured by NIPPON COKE &. ENGINEERING CO., LTD.) at a number of rotations of 20 $s^{-1}$ and a rotation time of 5 minutes, and thereafter the resulting mixture was kneaded in a biaxial kneader (PCM-30 model, manufactured by Ikegai, Ltd.) at a temperature set to 125° C. The obtained kneaded product was cooled, and then coarsely pulverized into a size of 1 mm or less with a hammer mill, whereby a coarsely pulverized product was obtained. The obtained coarsely pulverized product was finely pulverized with a mechanical type pulverizer (T-250, manufactured by FREUND TURBO). The resultant product was classified by using a rotary classifier (200TSP, manufactured by Hosokawa Micron Group) to give toner particle. The classification was performed under the operation conditions of the rotary classifier (200TSP, manufactured by Hosokawa Micron Group) of the number of rotations of a motor of 50.0 $s^{-1}$. The weight average particle diameter (D4) of the obtained toner particle was 5.9 μm.

The obtained toner particle was subjected to heat treatment in a surface treatment apparatus illustrated in FIGURE. The operation conditions were as follows: Feed rate=5 kg/hr, Hot air temperature C=170° C., Hot air flow rate=6 $m^3$/min, Cold air temperature E=5° C., Cold air flow rate=4 $m^3$/min, Cold air absolute moisture content=3 g/$m^3$, Blower airflow=20 $m^3$/min, and Injection air flow rate=1 $m^3$/min.

To 100 parts by mass of the obtained treated toner particle, the following materials were added, and then mixed in a Henschel mixer (FM-75 Model, manufactured by NIPPON COKE &. ENGINEERING CO., LTD.) at a number of rotations of 60 $s^{-1}$ and a rotation time of 15 minutes to give a toner 6. Silica particle 2: 5.0 parts by mass; Hydrophobic silica fine particle having a specific surface area of 90 $m^2$/g subjected to surface treatment with 20% by mass of hexamethyldisilazane: 0.8 part by mass; and Titanium oxide fine particle having a specific surface area of 30 $m^2$/g subjected to surface treatment with 16% by mass of isobutyltrimethoxysilane: 0.2 part by mass The average circularity and the weight average particle diameter (D4) of the obtained toner 6 were 0.972 and 6.4 μm, respectively. The physical properties of the obtained toner 6 are shown in Table 2.

Production Example of Toner 7

A toner 7 was obtained in the same manner as in the production example of toner 6, except changing the addition amount of the silica particle 2 to 3.0 parts by mass and the conditions of the Henschel mixer to a number of rotations of 30 $s^{-1}$ and a rotation time to 10 minutes. The physical properties of the obtained toner 7 are shown in Table 2.

Production Example of Toners 8 to 25

Toners 8 to 25 were obtained in the same manner as in the production example of toner 7, except changing the type and the addition amount of silica particle as shown in Table 2. The physical properties of the obtained toners 8 to 25 are shown in Table 2.

Production Example of Toners 26 to 30

Toners 26 to 30 were obtained in the same manner as in the production example of toner 1, except changing the type and the addition amount of silica particle and the hot air temperature of the surface treatment apparatus as shown in Table 2. The physical properties of the obtained toner 26 to 30 are shown in Table 2.

TABLE 2

Table 2

| | Silica type | Silica addition amount (part(s) by mass) | Presence or absence of external addition process before heat treatment process | Presence or absence of heat treatment process | Treatment temperature (° C.) | Average circularity | Coverage (%) | Sticking ratio (% by mass) |
|---|---|---|---|---|---|---|---|---|
| Toner 1 | Silica particle 1 | 5.0 | Done | Done | 150 | 0.960 | 65 | 98 |
| Toner 2 | Silica particle 1 | 5.0 | None | None | — | 0.955 | 65 | 80 |
| Toner 3 | Silica particle 1 | 5.0 | Done | Done | 160 | 0.968 | 65 | 98 |
| Toner 4 | Silica particle 1 | 5.0 | Done | Done | 170 | 0.972 | 65 | 98 |
| Toner 5 | Silica particle 1 | 5.0 | Done | Done | 168 | 0.971 | 65 | 65 |
| Toner 6 | Silica particle 2 | 5.0 | None | Done | 163 | 0.970 | 65 | 52 |
| Toner 7 | Silica particle 2 | 3.0 | None | Done | 170 | 0.972 | 40 | 15 |
| Toner 8 | Silica particle 2 | 8.0 | None | Done | 170 | 0.972 | 85 | 10 |
| Toner 9 | Silica particle 3 | 2.5 | None | Done | 170 | 0.972 | 32 | 20 |
| Toner 10 | Silica particle 3 | 8.5 | None | Done | 170 | 0.972 | 90 | 20 |
| Toner 11 | Silica particle 4 | 8.5 | None | Done | 170 | 0.972 | 90 | 20 |
| Toner 12 | Silica particle 5 | 1.0 | None | Done | 170 | 0.972 | 25 | 20 |

TABLE 2-continued

Table 2

| | Silica type | Silica addition amount (part(s) by mass) | Presence or absence of external addition process before heat treatment process | Presence or absence of heat treatment process | Treatment temperature (° C.) | Average circularity | Coverage (%) | Sticking ratio (% by mass) |
|---|---|---|---|---|---|---|---|---|
| Toner 13 | Silica particle 6 | 2.0 | None | Done | 170 | 0.972 | 25 | 18 |
| Toner 14 | Silica particle 7 | 0.5 | None | Done | 170 | 0.972 | 25 | 20 |
| Toner 15 | Silica particle 8 | 3.0 | None | Done | 170 | 0.972 | 25 | 16 |
| Toner 16 | Silica particle 9 | 0.8 | None | Done | 170 | 0.972 | 25 | 20 |
| Toner 17 | Silica particle 10 | 4.5 | None | Done | 170 | 0.972 | 25 | 12 |
| Toner 18 | Silica particle 11 | 0.7 | None | Done | 170 | 0.972 | 25 | 20 |
| Toner 19 | Silica particle 12 | 0.7 | None | Done | 170 | 0.972 | 25 | 20 |
| Toner 20 | Silica particle 13 | 0.7 | None | Done | 170 | 0.972 | 25 | 20 |
| Toner 21 | Silica particle 14 | 0.7 | None | Done | 170 | 0.972 | 25 | 20 |
| Toner 22 | Silica particle 15 | 0.7 | None | Done | 170 | 0.972 | 25 | 20 |
| Toner 23 | Silica particle 16 | 0.7 | None | Done | 170 | 0.972 | 25 | 20 |
| Toner 24 | Silica particle 17 | 0.7 | None | Done | 170 | 0.972 | 25 | 20 |
| Toner 25 | Silica particle 18 | 0.7 | None | Done | 170 | 0.972 | 25 | 20 |
| Toner 26 | Silica particle 19 | 0.8 | Done | Done | 165 | 0.968 | 32 | 68 |
| Toner 27 | Silica particle 20 | 0.8 | Done | Done | 165 | 0.968 | 32 | 70 |
| Toner 28 | Silica particle 21 | 2.0 | Done | Done | 169 | 0.968 | 32 | 69 |
| Toner 29 | Silica particle 22 | 0.8 | Done | Done | 165 | 0.968 | 32 | 78 |
| Toner 30 | Silica particle 23 | 4.5 | Done | Done | 160 | 0.968 | 32 | 60 |

Production Example of Magnetic Carrier 1

A mixed liquid of the following materials was added to 100 parts by mass of magnetite particle having a 50% particle diameter (D50) on a volume basis of 31 μm, and then decompressed and dried at a temperature of 75° C. for 5 hours while stirring and mixing the mixed liquid with a solution decompression kneader to remove the solvent.

Silicone resin (manufactured by Shin-Etsu Chemical Co., Ltd.: KR271): 1 part by mass;

γ-aminopropyltriethoxysilane: 0.5 part by mass; and

Toluene: 98.5 parts by mass

Thereafter, the resultant substance was subjected to baking treatment at a temperature of 145° C. for 2 hours, and then sieved with a sieve shaker (300MM-2 model, manufactured by TSUTSUI SCIENTIFIC INSTRUMENTS CO., LTD.: 75 μm opening) to give a magnetic carrier 1.

Examples 1 to 25 and Comparative Examples 1 to 4

The toner 1 and the magnetic carrier 1 were mixed in a V-type mixer (V-10 model: manufactured by Tokuju Corporation) at a number of rotations of 0.5 $s^{-1}$ and a rotation time of 5 minutes, so that the toner concentration reached 9% by mass to give a two-component developer 1. The toner and the magnetic carrier to be combined were changed as shown in Table 3 to give two-component developers 2 to 30. Then, the two-component developers of Examples 1 to 25 and Comparative Examples 1 to 5 were evaluated as follows. The evaluation results of Examples 1 to 25 and Comparative Examples 1 to 5 are shown in Table 4.

Table 3

TABLE 3

| | Toner No. | Carrier No. | Two-component developer No. |
|---|---|---|---|
| Example 1 | Toner 1 | Carrier 1 | Two-component developer 1 |
| Example 2 | Toner 2 | Carrier 1 | Two-component developer 2 |
| Example 3 | Toner 3 | Carrier 1 | Two-component developer 3 |
| Example 4 | Toner 4 | Carrier 1 | Two-component developer 4 |
| Example 5 | Toner 5 | Carrier 1 | Two-component developer 5 |
| Example 6 | Toner 6 | Carrier 1 | Two-component developer 6 |
| Example 7 | Toner 7 | Carrier 1 | Two-component developer 7 |
| Example 8 | Toner 8 | Carrier 1 | Two-component developer 8 |
| Example 9 | Toner 9 | Carrier 1 | Two-component developer 9 |
| Example 10 | Toner 10 | Carrier 1 | Two-component developer 10 |
| Example 11 | Toner 11 | Carrier 1 | Two-component developer 11 |
| Example 12 | Toner 12 | Carrier 1 | Two-component developer 12 |
| Example 13 | Toner 13 | Carrier 1 | Two-component developer 13 |
| Example 14 | Toner 14 | Carrier 1 | Two-component developer 14 |
| Example 15 | Toner 15 | Carrier 1 | Two-component developer 15 |
| Example 16 | Toner 16 | Carrier 1 | Two-component developer 16 |
| Example 17 | Toner 17 | Carrier 1 | Two-component developer 17 |
| Example 18 | Toner 18 | Carrier 1 | Two-component developer 18 |
| Example 19 | Toner 19 | Carrier 1 | Two-component developer 19 |
| Example 20 | Toner 20 | Carrier 1 | Two-component developer 20 |
| Example 21 | Toner 21 | Carrier 1 | Two-component developer 21 |
| Example 22 | Toner 22 | Carrier 1 | Two-component developer 22 |
| Example 23 | Toner 23 | Carrier 1 | Two-component developer 23 |

TABLE 3-continued

| | Toner No. | Carrier No. | Two-component developer No. |
|---|---|---|---|
| Example 24 | Toner 24 | Carrier 1 | Two-component developer 24 |
| Example 25 | Toner 25 | Carrier 1 | Two-component developer 25 |
| Comparative Example 1 | Toner 26 | Carrier 1 | Two-component developer 26 |
| Comparative Example 2 | Toner 27 | Carrier 1 | Two-component developer 27 |
| Comparative Example 3 | Toner 28 | Carrier 1 | Two-component developer 28 |
| Comparative Example 4 | Toner 29 | Carrier 1 | Two-component developer 29 |
| Comparative Example 5 | Toner 30 | Carrier 1 | Two-component developer 30 |

Evaluation Method of Image Density Changes after Durability Test

A converted machine of a full-color copying machine (Trade Name: ImagePRESS C800) manufactured by CANON KABUSHIKI KAISHA was used as an image forming apparatus (electrophotographic apparatus), and then the two-component developer 1 was charged into a development device of a cyan station to perform an evaluation.

The evaluation environment was set as follows: Normal temperature and normal humidity environment (Temperature of 23° C. and Relative humidity of 50%) and High temperature and high humidity environment (Temperature of 30° C. and Relative humidity of 80%). As an evaluation paper, a copy paper CS-814 (A4 paper, Basis weight of 81.4 g/m$^2$) available from Canon Marketing Japan, Inc. was used.

The image density changes before and after a durability test in each environment were evaluated. In each environment, the development voltage was initially adjusted so that the toner applied amount of an FFh image was 0.40 mg/cm$^2$. Using an X-Rite color reflection density meter (500 series: manufactured by X-Rite), 50,000 FFh images with a size of 5 cm×5 cm were output, and then the image densities of the 1st image and the 50,000th image were measured. A difference (a density difference, uneven density) between the image density in the early stage (1st image) and the image density after the durability test (50,000th image) was evaluated under the following criteria.

Evaluation Criteria

A: Less than 0.05

B: 0.05 or more and less than 0.10

C: 0.10 or more and less than 0.20

D: 0.20 or more

B is good and A is very good.

Evaluation Method of Fogging in Non-Image Portion (White Background Portion)

A converted machine of a full-color copying machine (Trade Name: ImagePRESS C800) manufactured by CANON KABUSHIKI KAISHA was used as an image forming apparatus (electrophotographic apparatus), and then the two-component developer 1 was charged into a development device of a cyan station to perform an evaluation.

The evaluation environment was set as follows: Normal temperature and normal humidity environment (Temperature of 23° C. and Relative humidity of 50%) and High temperature and high humidity environment (Temperature of 30° C. and Relative humidity of 80%). As an evaluation paper, a copy paper CS-814 (A4 paper, Basis weight of 81.4 g/m$^2$) available from Canon Marketing Japan, Inc. was used. Fogging in the white background portion before and after the durability test in each environment was measured.

The average reflectivity Dr (%) of the evaluation paper before an image was output was measured using a reflectometer (REFLECTOMETER MODEL TC-6DS, manufactured by Tokyo Denshoku Co., Ltd.)

The reflectivity Ds (%) of a OOH image portion (white background portion) after the durability test (50,000th image) was measured. The fogging was calculated from the obtained Dr and Ds using the following equation. The determined fogging was evaluated in accordance with the following evaluation criteria.

$$\text{Fogging}(\%)=Dr(\%)-Ds(\%)$$

Evaluation Criteria

A: Less than 0.5%

B: 0.5% or more and less than 1.0%

C: 1.0% or more and less than 2.0%

D: 2.0% or more

B is good and A is very good.

TABLE 4

Table 4

| | Density changes | | | | Fogging in non-image portion | | | |
|---|---|---|---|---|---|---|---|---|
| | Normal temperature-Normal humidity environment (NN) | | High temperature-High humidity environment (HH) | | Normal temperature-Normal humidity environment (NN) | | High temperature-High humidity environment (HH) | |
| | Density difference | Rank | Density difference | Rank | Fogging value | Rank | Fogging value | Rank |
| Example 1 | 0.00 | A | 0.01 | A | 0.1 | A | 0.1 | A |
| Example 2 | 0.01 | A | 0.02 | A | 0.1 | A | 0.3 | A |
| Example 3 | 0.01 | A | 0.02 | A | 0.3 | A | 0.5 | B |
| Example 4 | 0.02 | A | 0.03 | A | 0.2 | A | 0.5 | B |
| Example 5 | 0.01 | A | 0.05 | B | 0.5 | B | 0.6 | B |
| Example 6 | 0.03 | A | 0.07 | B | 0.6 | B | 0.5 | B |
| Example 7 | 0.03 | A | 0.09 | B | 0.6 | B | 0.7 | B |
| Example 8 | 0.03 | A | 0.09 | B | 0.7 | B | 0.8 | B |
| Example 9 | 0.04 | A | 0.09 | B | 0.9 | B | 1.0 | C |
| Example 10 | 0.04 | A | 0.09 | B | 0.7 | B | 1.1 | C |
| Example 11 | 0.04 | A | 0.09 | B | 0.8 | B | 1.3 | C |
| Example 12 | 0.05 | B | 0.09 | B | 0.7 | B | 1.2 | C |
| Example 13 | 0.05 | B | 0.09 | B | 0.8 | B | 1.2 | C |
| Example 14 | 0.05 | B | 0.09 | B | 0.9 | B | 1.3 | C |

TABLE 4-continued

Table 4

| | Density changes | | | | Fogging in non-image portion | | | |
|---|---|---|---|---|---|---|---|---|
| | Normal temperature-Normal humidity environment (NN) | | High temperature-High humidity environment (HH) | | Normal temperature-Normal humidity environment (NN) | | High temperature-High humidity environment (HH) | |
| | Density difference | Rank | Density difference | Rank | Fogging value | Rank | Fogging value | Rank |
| Example 15 | 0.05 | B | 0.10 | C | 0.9 | B | 1.3 | C |
| Example 16 | 0.06 | B | 0.09 | B | 0.9 | B | 1.4 | C |
| Example 17 | 0.05 | B | 0.10 | C | 0.9 | B | 1.5 | C |
| Example 18 | 0.07 | B | 0.10 | C | 0.7 | B | 1.4 | C |
| Example 19 | 0.06 | B | 0.10 | C | 0.8 | B | 1.4 | C |
| Example 20 | 0.07 | B | 0.12 | C | 0.7 | B | 1.5 | C |
| Example 21 | 0.08 | B | 0.14 | C | 0.9 | B | 1.5 | C |
| Example 22 | 0.09 | B | 0.15 | C | 0.9 | B | 1.5 | C |
| Example 23 | 0.09 | B | 0.15 | C | 0.8 | B | 1.6 | C |
| Example 24 | 0.09 | B | 0.16 | C | 0.9 | B | 1.6 | C |
| Example 25 | 0.09 | B | 0.16 | C | 0.9 | B | 1.5 | C |
| Comparative Example 1 | 0.14 | C | 0.18 | C | 1.3 | C | 1.8 | C |
| Comparative Example 2 | 0.11 | C | 0.17 | C | 1.2 | C | 1.7 | C |
| Comparative Example 3 | 0.17 | C | 0.18 | C | 1.5 | C | 1.8 | C |
| Comparative Example 4 | 0.14 | C | 0.19 | C | 1.5 | C | 1.8 | C |
| Comparative Example 5 | 0.14 | C | 0.16 | C | 1.4 | C | 1.8 | C |

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-248312, filed Dec. 21, 2015, which is hereby incorporated by reference herein in its entirety.

What is claimed is:

1. A toner comprising:

a toner particle containing a binding resin and a colorant; and an inorganic fine particle, wherein:

the inorganic fine particle is a silica particle containing aluminum, a content of the aluminum in the silica particle is 0.2 ppm or more and 200 ppm or less, the silica particle is stuck on a surface of the toner particle with a sticking ratio of 70% by mass or more and 100% by mass or less, the sticking ratio is represented by the following equation:

$$\text{sticking ratio}=\{1-(P1-P2)/P1\}\times 100$$

P1 represents the $SiO_2$ amount (% by mass) of initial toner, and P2 represents the $SiO_2$ amount (% by mass) of the toner after the removal of the silica particle not stuck to the surface of the toner particle, and the removal of the silica particle not stuck to the surface of the toner particle comprises:

(i) adding 160 g of sucrose to 100 mL of ion exchanged water, and then dissolving with hot water to prepare a sucrose solution;

(ii) charging a solution prepared by adding 23 mL of the sucrose solution and 6.0 mL of nonionic surfactant into a 50 mL polyethylene sealable sample bottle, and adding 1.0 g of a sample of initial toner;

(iii) after adding the sample of initial toner, sealing the sample bottle;

(iv) after sealing the sample bottle, shaking the sample bottle, and then standing the sample bottle still for 1 hour;

(v) after the sample bottle stands still for 1 hour, shaking the sample bottle at 350 spm for 20 minutes with a shaker;

(vi) after shaking the sample bottle with the shaker, transferring the contents of the sample bottle into a vessel;

(vii) centrifuging the contents transferred into the vessel with a high speed cooling centrifuge under the conditions of: a set temperature of 20° C., the shortest acceleration/deceleration time permitted by the high speed cooling centrifuge, a number of rotations of 3,500 rpm, and a rotation time of 30 minutes; and (viii) after centrifuging the contents, collecting a toner separated at a topmost portion of the centrifuged contents, filtering with a vacuum filter, and then drying with a drier for 1 hour or more.

2. The toner according to claim 1, wherein a shape factor SF-1 of the silica particle is 135 or more and less than 180.

3. The toner according to claim 1, wherein a specific surface area of the silica particle is 5 $m^2/g$ or more and 50 $m^2/g$ or less.

4. A two-component developer comprising:

a toner; and a magnetic carrier, wherein:

the toner is a toner containing:

a toner particle containing a binding resin and a colorant and an inorganic fine particle, the inorganic fine particle is a silica particle containing aluminum, and a content of the aluminum in the silica particle is 0.2 ppm or more and 200 ppm or less, a sticking ratio to the surface of the toner particle of the silica particle is 70% by mass or more and 100% by mass or less, the sticking ratio is represented by the following equation:

$$\text{sticking ratio}=\{1-(P1-P2)/P1\}\times 100$$

P1 represents the $SiO_2$ amount (% by mass) of initial toner, and P2 represents the $SiO_2$ amount (% by mass) of the toner after the removal of the silica particle not stuck to the surface of the toner particle, and the removal of the silica particle not stuck to the surface of the toner particle comprises:

(i) adding 160 q of sucrose to 100 mL of ion exchanged water, and then dissolving with hot water to prepare a sucrose solution;

(ii) charging a solution prepared by adding 23 mL of the sucrose solution and 6.0 mL of nonionic surfactant into a 50 mL polyethylene sealable sample bottle, and adding 1.0 q of a sample of initial toner;

(iii) after adding the sample of initial toner, sealing the sample bottle;

(iv) after sealing the sample bottle, shaking the sample bottle, and then standing the sample bottle still for 1 hour;

(v) after the sample bottle stands still for 1 hour, shaking the sample bottle at 350 spm for 20 minutes with a shaker;

(vi) after shaking the sample bottle with the shaker, transferring the contents of the sample bottle into a vessel;

(vii) centrifuging the contents transferred into the vessel with a high speed cooling centrifuge under the conditions of: a set temperature of 20° C., the shortest acceleration/deceleration time permitted by the high speed cooling centrifuge, a number of rotations of 3,500 rpm, and a rotation time of 30 minutes; and (viii) after centrifuging the contents, collecting a toner separated at a topmost portion of the centrifuged contents, filtering with a vacuum filter, and then drying with a drier for 1 hour or more.

5. The toner according to claim 1, wherein a coverage with the silica particle of a surface of the toner particle is 30% or more and 90% or less.

6. The toner according to claim 1, wherein an average circularity of the toner is less than 0.970.

* * * * *